US006614324B2

(12) United States Patent
Ohira et al.

(10) Patent No.: US 6,614,324 B2
(45) Date of Patent: Sep. 2, 2003

(54) CENTER ELECTRODE ASSEMBLY, NONRECIPROCAL CIRCUIT DEVICE, AND COMMUNICATION APPARATUS

(75) Inventors: Katsuyuki Ohira, Ishikawa-gun (JP); Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/950,906

(22) Filed: Sep. 12, 2001

(65) Prior Publication Data

US 2002/0047663 A1 Apr. 25, 2002

(30) Foreign Application Priority Data

Sep. 13, 2000 (JP) ..... 2000-278356
Jul. 4, 2001 (JP) ..... 2001-203675

(51) Int. Cl.[7] ..... H01P 1/32
(52) U.S. Cl. ..... 333/1.1; 333/24.2
(58) Field of Search ..... 333/1.1, 24.2; H01P 1/383, 1/36

(56) References Cited

U.S. PATENT DOCUMENTS 4,246,552 A * 1/1981 Fukasawa et al. ..... 333/1.1
5,745,014 A * 4/1998 Okada et al. ..... 333/1.1
5,994,974 A * 11/1999 Makino et al. ..... 333/1.1 X

FOREIGN PATENT DOCUMENTS

| | | | | |
|---|---|---|---|---|
| JP | 06-204711 A | * | 7/1994 | ..... H01P/1/383 |
| JP | 11-068412 A | * | 3/1999 | ..... H01P/1/383 |
| JP | 11-068413 A | * | 3/1999 | ..... H01P/1/383 |
| JP | 2000-252708 A | * | 9/2000 | ..... H01P/1/36 |
| WO | WO 98/53519 A1 | * | 11/1998 | ..... H01P/1/387 |

* cited by examiner

*Primary Examiner*—Robert Pascal
*Assistant Examiner*—Stephen E. Jones
(74) *Attorney, Agent, or Firm*—Keating & Bennett, LLP

(57) ABSTRACT

A center electrode assembly, a nonreciprocal circuit device, and a communication apparatus are provided which have stable physical properties and high reliability, and which eliminate the risk of line breakage of the center electrodes thereof. The center electrode assembly includes an electrode assembly wherein a plurality of center electrodes extend outward from the center planar portion (ground electrode) thereof at a predetermined angular distance; and a ferrite. The center planar portion is abutted against the bottom surface of the ferrite, then the center electrodes are wrapped around the top surface of the ferrite across the side surface thereof, and these center electrodes are crossed with one another on the top surface of the ferrite. At least one center electrode is formed of one line, and the line width of the center electrode is set to be partly larger at the ferrite edge portion on the cold-end side.

9 Claims, 20 Drawing Sheets

CENTER ELECTRODE ASSEMBLY, NONRECIPROCAL CIRCUIT DEVICE, AND COMMUNICATION APPARATUS

BACKGROUND OF THE INVENTION

1. Field of the Invention

The present invention relates to a center electrode assembly and a nonreciprocal circuit device which may constitute an isolator or a circulator for use in, for example, a microwave band, and relates to a communication apparatus including this nonreciprocal device.

2. Description of the Related Art

A center electrode assembly shown in FIGS. 30A and 30B is known for use in a concentrated-constant type isolator (nonreciprocal circuit device) adopted in mobile communication equipment such as mobile telephones. This center electrode assembly 200 is formed by wrapping a disk shaped microwave ferrite 201 in an electrode assembly 210 including three center electrodes 211, 212, and 213.

The electrode assembly 210 is formed by extending outward the center electrodes 211, 212, and 213 at predetermined angles from the center planar portion (ground electrode) 215. The center electrodes 211 and 212 are formed of one line, while the center electrode 213 is formed of two lines. In assembly, firstly the center planar portion 215 is abutted against the bottom surface of the ferrite 201, then the center electrodes 211, 212, and 213 are wrapped around the top surface of the ferrite 201 across the side surface thereof (by making folded portions marked "a" and "b"), and these center electrodes are crossed with one another at predetermined crossing angles, on the top surface of the ferrite 201.

A nonreciprocal circuit device having this type of center electrode assembly 200 is mainly used in mobile communication equipment, and significant progress is being made in miniaturizing it. Since the electrode assembly 210 requires more miniaturization, the line width of each of the center electrodes 211, 212, and 213 is being made smaller. Such center electrodes are formed by press work using a mold or by etching work, but there are limits to the working accuracy available. It is, therefore, difficult to form all center electrodes so as to have two lines, and currently, at least one of them is generally formed of one line.

FIG. 31 shows another conventional center electrode assembly. In this center electrode assembly 240, an input center electrode 271, an output center electrode 272, and a terminal center electrode 273 are arranged on the top surface of a microwave ferrite 270 with insulating sheets 220 interposed between them so that the crossing angle G formed among mutually crossing center lines thereof becomes about 120°. First ends of the center electrodes 271, 272, and 273 are electrically connected to port portions P1, P2, and P3, respectively. The other ends of the center electrodes 271, 272, and 273 extend across the side surface of the ferrite 270, and are electrically connected to ground electrode 276 provided on the bottom surface of the ferrite 270. The ground electrode 276 covers substantially the entire bottom surface of the ferrite 270.

In a center electrode assembly incorporated into a concentrated-constant type nonreciprocal circuit device, if the crossing angle formed among three center electrodes varies, it will significantly influence the electrical characteristics thereof such as the insertion loss and the isolation. It is, therefore, very important to ensure the stabilization of the crossing angle.

However, in the conventional center electrode assembly 200 shown in FIGS. 30A and 30B, since each of the center electrodes has a small line width, there is the risk that a line may break due to vibration and heating during assembly or during operation of communication equipment in which the center electrode assembly is incorporated. Such line breakage occurs especially at folded portions "a" and/or "b". In particular, the line breakage of a center electrode formed of one line could cause a critical defect.

As indices of the performance of an isolator, there are insertion loss and isolation. The lower the insertion loss, the better the isolator. The wider the isolation bandwidth, the better the isolation characteristic. In FIG. 32, there is shown the relationship between the insertion loss 280 and the isolation characteristic 282 of the isolator in which the above-described center electrode assembly 240, of which the crossing angle G is 120°, is incorporated (see the dotted lines).

Now, as a method for improving the insertion loss, it is known to increase the crossing angle G formed between the input center electrode 271 and the output center electrode 272. For example, in FIG. 32, there is shown the relationship between the insertion loss 281 and the isolation characteristic 283 of the isolator incorporating the above-described center electrode assembly 240 when the crossing angle G is changed to 125° (see the solid lines). However, although this method can improve the insertion loss, this method reduces the isolation bandwidth, and is prone to increase the fraction of defective manufactured parts due to variations in characteristics among production lots of the center electrode assembly 240.

Furthermore, enlarging the crossing angle formed between the input center electrode 271 and the output center electrode 272 reduces the distance A–A' from the intersection point A (see FIG. 31) of the edge of the input center electrode 271 and that of the output center electrode 272 to the edges of the insulating sheets 220. As a result, if the insulating sheets 220 are displaced to the position 220*a* indicated by the two-dot chain line 220*a*, short-circuit failures are prone to occur between the input center electrode 271 and the output center electrode 272.

SUMMARY OF THE INVENTION

The present invention provides a center electrode assembly and a nonreciprocal circuit device, and a communication apparatus incorporating them, which have stable physical properties and high reliability, and which eliminate the risk of line breakage of the center electrodes thereof.

The present invention also provides a center electrode assembly and a nonreciprocal circuit device, and a communication apparatus incorporating them, which have improved the insertion loss without impairing other electrical characteristics, and which are less likely to have short-circuit failures.

In order to provide the foregoing, the present invention, in a first aspect, provides a center electrode assembly comprising an electrode assembly wherein a plurality of center electrodes extends outward from the center planar portion thereof at a predetermined angular distance; and a ferrite. In this center electrode assembly, the center planar portion is abutted against the bottom surface of the ferrite, then the center electrodes are wrapped around the top surface of the ferrite across the side surface thereof, and the center electrodes are crossed with each other on the top surface of the ferrite. At least one center electrode is formed of one line, and the line width of the above-mentioned center electrode is enlarged where it crosses the side surface of the ferrite near the center planar portion.

The present invention, in a second aspect, provides a center electrode assembly comprising an electrode assembly wherein a plurality of center electrodes extends outward from the center planar portion thereof at a predetermined angular distance; and a ferrite. In this center electrode assembly, the center planar portion is abutted against the bottom surface of the ferrite, then the center electrodes are wrapped around the top surface of the ferrite across the side surface thereof, and the center electrodes are crossed with each other on the top surface of the ferrite. At least one center electrode is formed of one line, and the line width of the above-mentioned center electrode is larger near the ferrite edge than near the ferrite center.

In the center electrode assembly in accordance with the first and second aspects, the ferrite is wrapped in the center electrodes by folding the center electrodes at the ferrite edge portions thereof near the center planar portion, that is, at the cold ends of the center electrodes. Since the ferrite edge portions thereof at the cold ends, which are folded portions, are formed wide, the ferrite edge portions have greater strength, thereby significantly reducing the risk of line breakage. Moreover, the crossing angle formed between the central electrodes is stabilized, resulting in superior electrical characteristics.

In the center electrode assembly in accordance with the first and second aspects, when there are provided first, second, and third center electrodes, it is preferable, for preventing electrical short circuits between the first and second center electrodes, that the crossing angle $\theta 12$ formed by a first center electrode and a second center electrode which is adjacent to the first center electrode on one side, be greater than the crossing angle $\theta 31$ formed by the first center electrode and a third center electrode which is adjacent to the first center electrode on the other side; that is, $\theta 12 > \theta 31$.

It is also preferable that the width of the ferrite edge portion of the first center electrode at the cold end be larger at the portion thereof close to the second center electrode than at the portion thereof close to the third center electrode, with respect to the center line at the ferrite center portion. The same effect can be obtained, even when the relationship between the crossing angles $\theta 12$ and $\theta 31$ is $\theta 12 < \theta 31$, by making the width of the ferrite edge portion of the first center electrode at the cold end larger at the portion thereof close to the third center electrode than at the portion thereof close to the second center electrode, with respect to the center line at the ferrite center portion.

Also, it is preferable that the width of the center electrode formed of one line gradually increase toward the ferrite edge portion for eliminating a rapid change in the line width and for relaxing the stress concentration.

In accordance with a third aspect, the present invention provides a center electrode assembly comprising an electrode assembly wherein a plurality of center electrode extends outward from the center planar portion thereof at a predetermined angular distance; and a ferrite. In this center electrode assembly, the center planar portion is abutted against the bottom surface of the ferrite, then the center electrodes are wrapped around the top surface of the ferrite across the side surface thereof, and the center electrodes are crossed with each other on the top surface of the ferrite. Also, each of the center electrodes has a smooth arc portion, and is continuous, with respect to the center planar portion.

The center electrode portions which are continuous with the center planar portion, correspond to the folded portions. Since each of these portions has a smooth arc shape, the stress concentration is relaxed, the risk of line breakage is significantly reduced, and the crossing angle formed between the center electrodes is stabilized, resulting in superior electrical characteristics.

In accordance with a fourth aspect, the present invention provides a center electrode assembly comprising a ferrite; an input center electrode, an output center electrode, and a terminal center electrode which are provided on a first main surface of the ferrite so as to intersect one another at a predetermined angle; a ground electrode which is disposed on a second main surface of the ferrite, and to which one end portion of each of the input center electrode, the output center electrode, and the terminal center electrode is connected; and an input port portion, an output port portion, and a terminal port portion which are connected to the other ends of the input center electrode, the output center electrode, and the terminal center electrode, respectively. In this center electrode assembly, at least one of the input center electrode, output center electrode, and terminal center electrode has a shape with a gradually-increasing width wherein the electrode width on the ground electrode side is larger than that on the port portion side.

With these features, since at least one of the input center electrode, output center electrode, and terminal center electrode has a gradually-increasing width wherein the electrode width on the ground electrode side is larger than that on the port portion side, although the ground electrode side exhibits the largest high-frequency currents, the concentration of high-frequency currents there is relaxed, and the insertion loss is improved without impairing the electrical characteristics such as the isolation characteristic.

The arrangement may be such that each of the input center electrode and the output center electrode has a gradually-increasing width on one side thereof, wherein the electrode width on the ground electrode side is larger than that on the port portion side, by extending the edge thereof closest to the terminal port portion, in the electrode width direction. These features prevent short-circuit failures among the center electrodes from occurring.

The nonreciprocal circuit device and a communication apparatus in accordance with the present invention have the center electrode assembly with the above-described features, thereby providing stable electrical characteristics and improving the reliability thereof.

The above and other features and advantages of the present invention will be clear from the following detailed description of embodiments of a center electrode assembly, a nonreciprocal circuit device, and a communication apparatus in accordance with the present invention in conjunction with the accompanying drawings. In the drawings illustrating these embodiments, like members and parts are given the same reference numerals, and repeated descriptions are omitted.

DESCRIPTION OF EMBODIMENTS OF THE INVENTION

First Embodiment, FIGS. 1 to 4

Figure 1:
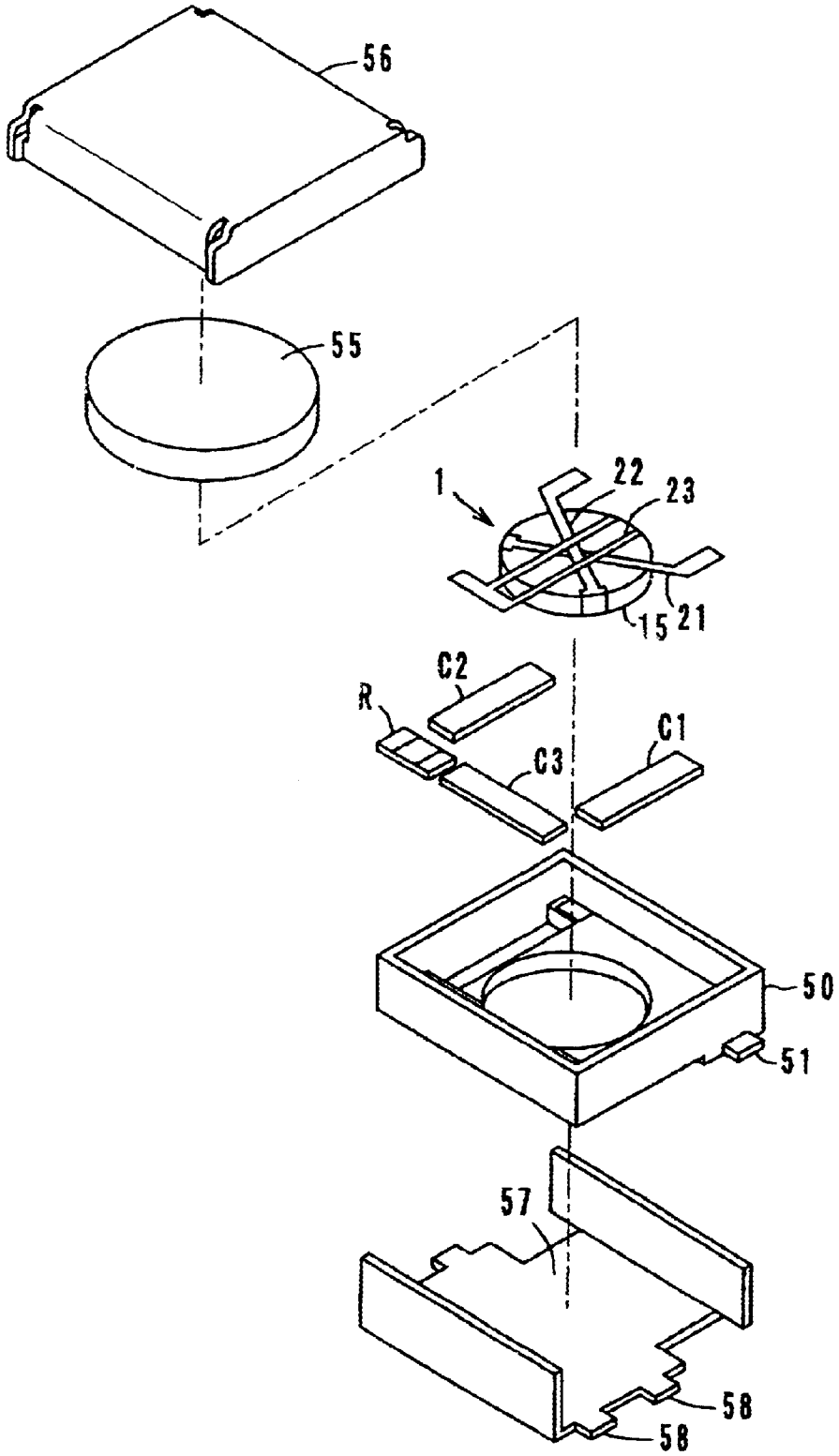
FIG. 1 is an exploded perspective view illustrating a nonreciprocal circuit device including a center electrode assembly in accordance with a first embodiment of the present invention.
Figure 2:
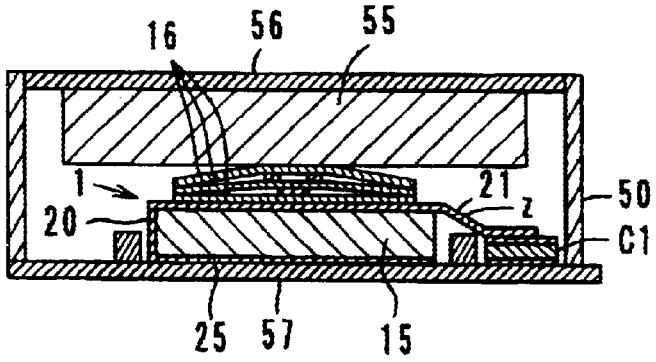
FIG. 2 is a sectional view illustrating the internal construction of the nonreciprocal circuit device shown in FIG. 1.
Figure 3A:
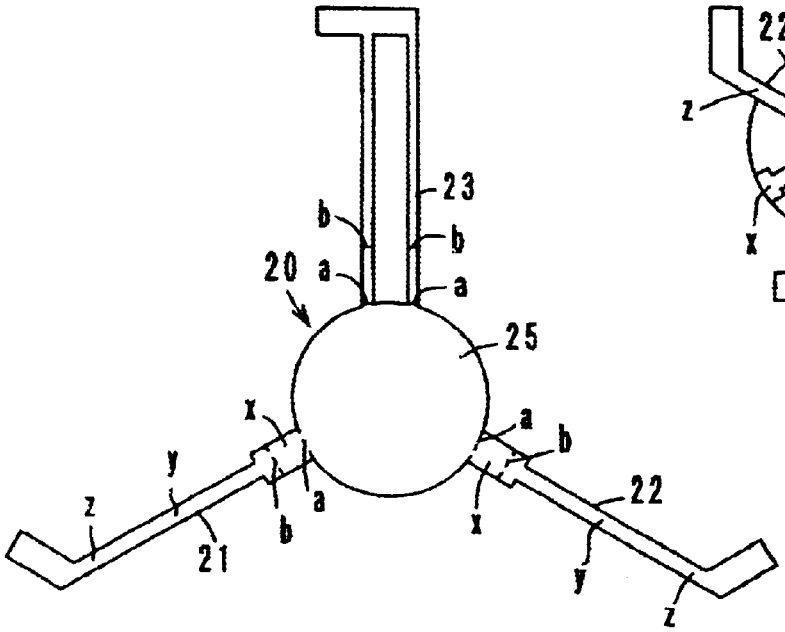
FIG. 3A is a development plan view of the electrode assembly of the center electrode assembly in accordance with the first embodiment.
Figure 3B:
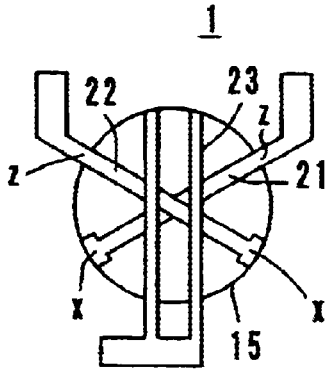
FIG. 3B is a plan view showing the state in which this electrode assembly and a ferrite have been assembled.
Figure 4:
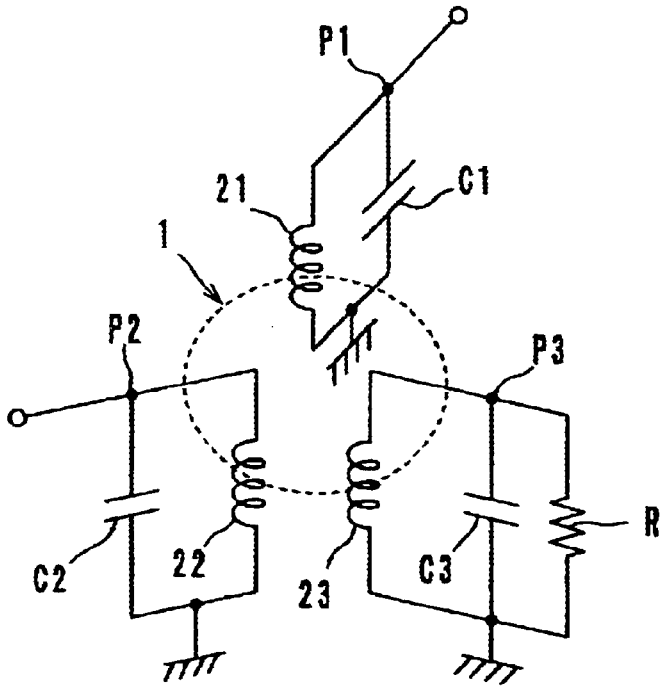
FIG. 4 is the electrical equivalent circuit of the nonreciprocal circuit device shown in FIG. 1.

FIG. 1 illustrates each of the components of a nonreciprocal circuit device (concentrated-constant type isolator) having a center electrode assembly 1 in accordance with a first embodiment of the present invention, and FIG. 2 is a sectional view showing a state wherein these components have been assembled. FIG. 3A is a development view of an electrode assembly 20, and FIG. 3B is a view showing the center electrode assembly 1. Also, FIG. 4 is the electrical equivalent diagram of the nonreciprocal circuit device.

In this nonreciprocal circuit device, the center electrode assembly 1, which will be detailed below, a permanent magnet 55, matching capacitors C1, C2, and C3, and a resistor element R are accommodated in a resin case 50, and are surrounded by yoke portions, hereinafter referred to as metallic cases 56 and 57, from above and below.

In the resin case 50, a conductor portion for serving as an input/output terminal 51, the capacitor elements C1, C2, and C3, and the resistor element R are provided, and in the metallic case 57, a ground terminal 58 is formed. These components are assembled in the case 50 so as to form the equivalent circuit shown in FIG. 4.

The circuit will be described with reference to FIG. 4. In the center electrodes 21, 22, and 23, hot ends thereof are used as input/output port portions P1, P2, and P3, respectively, and the other ends (cold ends) thereof are grounded. In the matching capacitors C1, C2, and C3, the hot-side electrodes thereof are soldered to the port portions P1, P2, and P3, respectively, and the cold side electrodes thereof are soldered to a ground electrode.

In the resistor element R, one terminal portion thereof is connected to the hot-side electrode of the matching capacitor element C3, and the other terminal portion thereof is connected to the ground electrode. In other words, the matching capacitor element C3 and the resistor element R are connected in parallel between the port portion P3 of the center electrode 23 and the ground electrode.

As shown in FIGS. 3A and 3B, the center electrode assembly 1 in accordance with the first embodiment is formed of a disk shaped ferrite 15 and an electrode assembly 20. In the electrode assembly 20, three center electrodes 21, 22, and 23 extend outward at a predetermined angular distance, from a center planar portion 25, which constitutes the ground electrode.

In the center electrode assembly 1, the center planar portion 25 of the electrode assembly 20 is abutted against the bottom surface of the ferrite 15, then the center electrodes 21, 22, and 23 are wrapped around the top surface of the ferrite 15 across the side surface thereof (folded at portions "a" and "b"), and the center electrodes 21, 22, and 23 are crossed with each other at a predetermined crossing angle, on the top surface of the ferrite 15. As shown in FIG. 2, on the top surface of the ferrite 15, the center electrodes 21, 22, and 23 are insulated from one another by inserting insulating sheets (such as polyimide sheets) 16.

Each of the center electrodes 21 and 22 is formed of one conductor line, while the center electrode 23 is formed of two conductor lines. The width of each of the center electrodes 21 and 22 formed of one conductor line is set to be larger at the ferrite edge portion x on the cold-end side than at the ferrite center portion y and the ferrite edge portion z on the hot-end side. The widened portion includes the folded portions "a" and "b".

In the center electrode assembly 1 in accordance with the first embodiment, since the center electrodes 21 and 22 are formed so as to have relatively wide folded portions "a" and "b", the folded portions "a" and "b" have a large strength, so that the bending angle is stabilized, and electrical characteristics such as the insertion loss and the isolation maintain stable desired values, thereby improving the uniformity of the input impedance characteristic and the like. In addition, the risk of line breakage at the folded portions "a" and "b" is reduced.

Figure 5A:
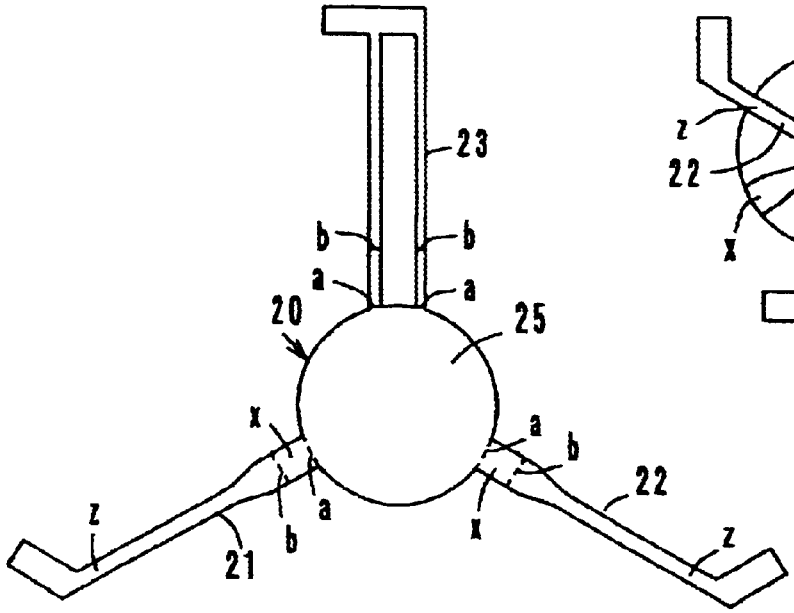
FIG. 5A is a development plan view of the electrode assembly of the center electrode assembly in accordance with a second embodiment of the present invention.
Figure 5B:
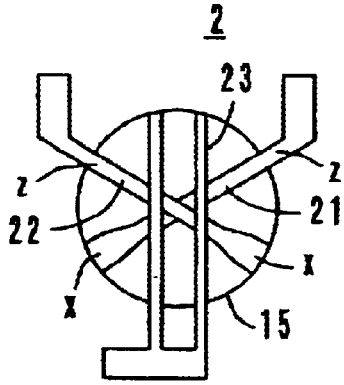
FIG. 5B is a plan view showing the state in which this electrode assembly and the ferrite have been assembled.

Second Embodiment, FIGS. 5A and 5B

A center electrode assembly 2 in accordance with a second embodiment of the present invention is configured by making the width of each of the center electrodes 21 and 22, which are each formed of one conductor line, so as to gradually increase (in a so-called reverse-tapered profile) from the center portion y up to the ferrite edge portion x on the cold-end side.

Other configurations of the second embodiment are the same as those of the above-described first embodiment, and the effects thereof also are fundamentally the same as those of the first embodiment. Furthermore, in the second embodiment, since the line width of the center electrodes 21 and 22 constitutes a so-called reverse tapered profile, no step difference occurs at the ferrite edge portion x on the cold-end side. Notably, this allows the stress concentration at the folded portion "b" to be avoided, thereby stabilizing even more the crossing angle formed among the center electrodes 21, 22, and 23 on the top surface of the ferrite 15.

Figure 6A:
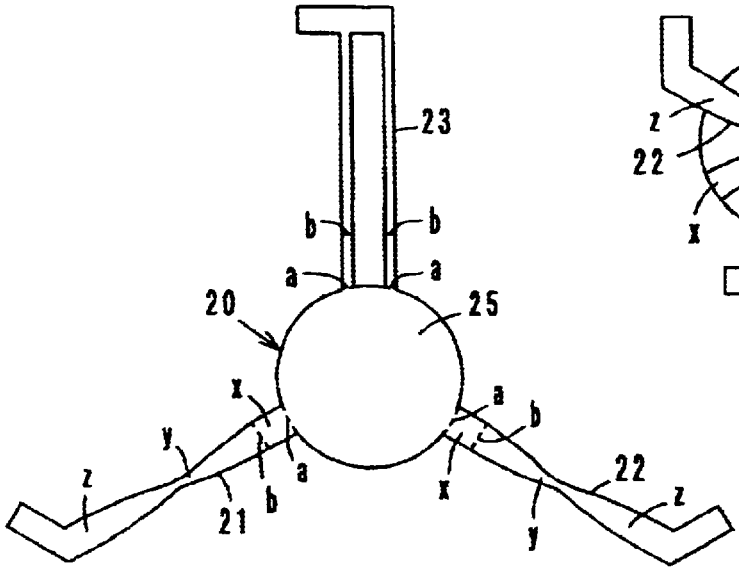
FIG. 6A is a development plan view of the electrode assembly of the center electrode assembly in accordance with a third embodiment of the present invention.
Figure 6B:
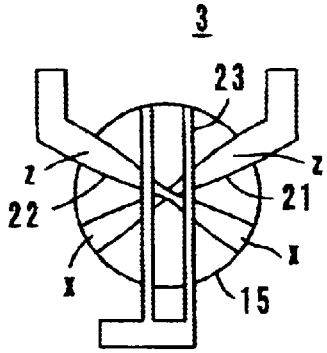
FIG. 6B is a plan view showing the state in which this electrode assembly and the ferrite have been assembled.

Third Embodiment, FIGS. 6A and 6B

A center electrode assembly 3 in accordance with a third embodiment is configured by making the width of each of the center electrodes 21 and 22, which are each formed of one conductor line, so as to gradually increase (in a so-called reverse-tapered profile) from the center portion y up to the ferrite edge portion x on the cold-end side, as well as up to the ferrite edge portion z on the hot-end side.

Other configurations of the third embodiment are the same as those of the above-described first and second embodiments, and the effects thereof also are fundamentally the same as those of the first and second embodiments.

In the third embodiment, the ferrite edge portion on the hot-end side z is also formed wide. As shown in FIG. 2, this edge portion z forms an angle of about 45° with the center portion y, and hence, if the line width here were small, the bending angle and bending shape thereof would not be stabilized, and could cause connection defects or line breakage between the capacitor elements and the center electrodes, or between the center electrodes and the input/output terminal. As in the third embodiment, by forming the edge portion z wide, the bending angle and the bending shape thereof can be stabilized, thereby reducing the risk of connection defects and line breakage.

Figure 7A:
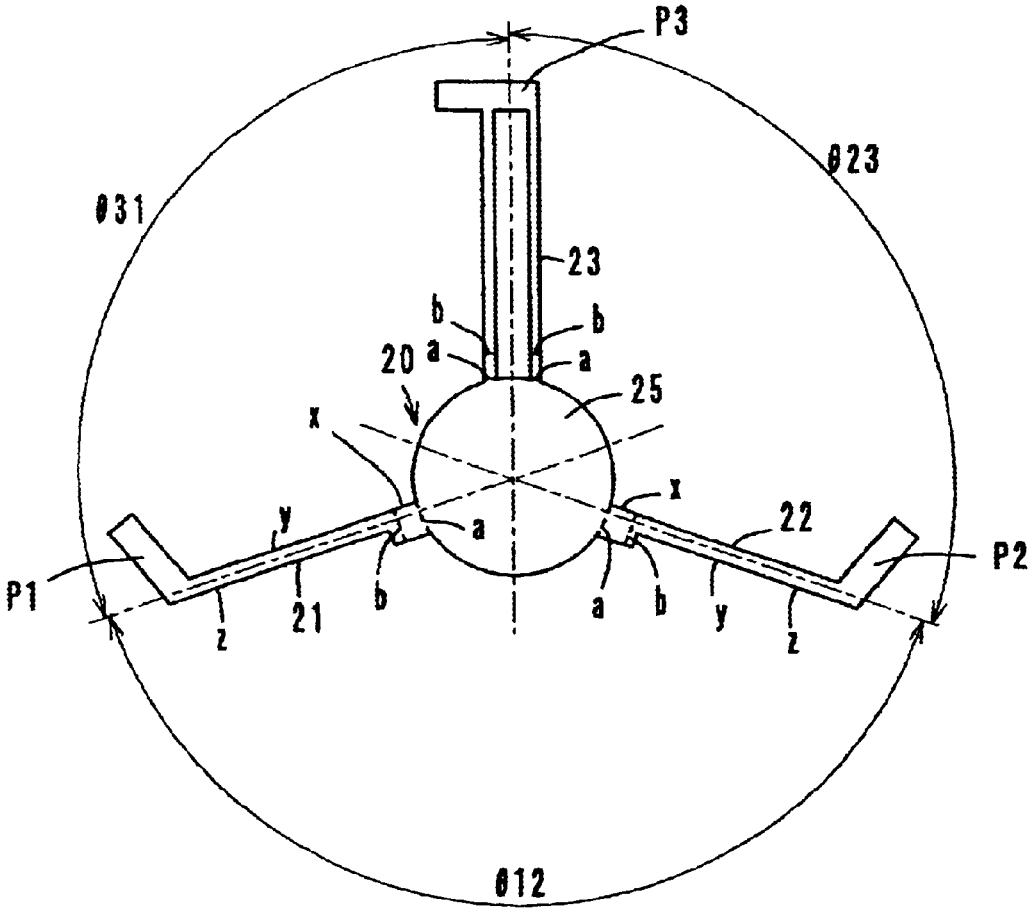
FIG. 7A is a development plan view of the electrode assembly of the center electrode assembly in accordance with a fourth embodiment of the present invention.
Figure 7B:
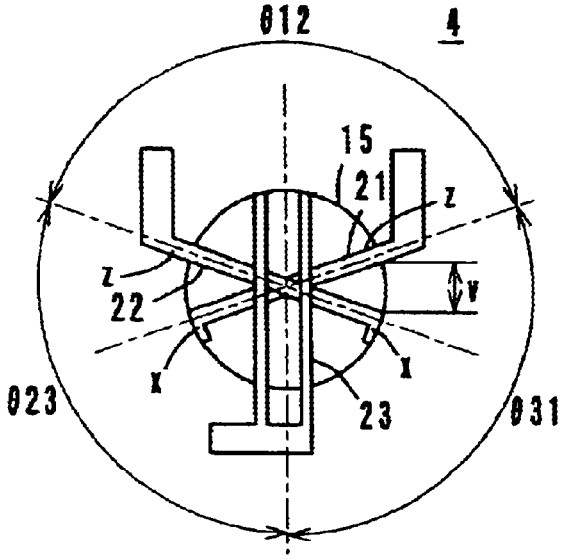
FIG. 7B is a plan view showing the state in which this electrode assembly and the ferrite have been assembled.

Fourth Embodiment, FIGS. 7A and 7B

A center electrode assembly 4 in accordance with a fourth embodiment is configured by setting the width of each of the center electrodes 21 and 22, which are each formed of one conductor line as in the case of the first embodiment, to be larger at the ferrite edge portion x on the cold-end side than at the ferrite edge portion z on the hot-end side.

Moreover, in the fourth embodiment, letting the crossing angle formed between the center electrodes 21 and 22 be $\theta 12$, the crossing angle formed between the center electrodes 21 and 23 be $\theta 31$, and the crossing angle formed between the center electrodes 22 and 23 be $\theta 23$, the relationships $\theta 12 > \theta 31$, and $\theta 12 > \theta 23$ hold.

Also, the line width at the ferrite edge portion x on the cold-end side of the center electrode 21 constituting the port portion P1, expands toward the side of the center electrode 22 constituting the port portion P2, with respect to the center line at the ferrite center portion y of the center electrode 21. Likewise, the line width at the ferrite edge portion x on the cold-end side of the center electrode 22 constituting the port portion P2, expands toward the side of the center electrode 21 constituting the port portion P1, with respect to the center line at the ferrite center portion y of center electrode 22.

The relationship between $\theta 31$ and $\theta 23$ may be $\theta 31 = \theta 23$, or $\theta 31 \neq \theta 23$.

The crossing angle $\theta 12$ is not necessarily required to be 120°. In order to improve the insertion loss between the port portions P1 and P2, the relation $120° < \theta 12 < 140°$ is desirable. If the crossing angle $\theta 12$ is not smaller than 140°, the isolation will deteriorate too much to be useful. On the other hand, if the crossing angle $\theta 12$ is smaller than 120°, the insertion loss will deteriorate.

Also, when $\theta 12 > 120°$, the port impedance of the port portion P3 becomes higher than when $\theta 012 = 120°$, and hence, it is desirable to form the center electrode 23 constituting the port portion P3 using a plurality of lines, to reduce the port impedance.

Other configurations of the fourth embodiment are the same as those of the above-described first embodiment, and the effects thereof also are fundamentally the same as those of the first embodiment. Furthermore, in the fourth embodiment, when the above-described electrode plate 20 and the ferrite 15 are assembled into the center electrode assembly 4, the distance v between the center electrodes 21 and 22 becomes larger, so that electric short circuits therebetween can be prevented.

Figure 8A:
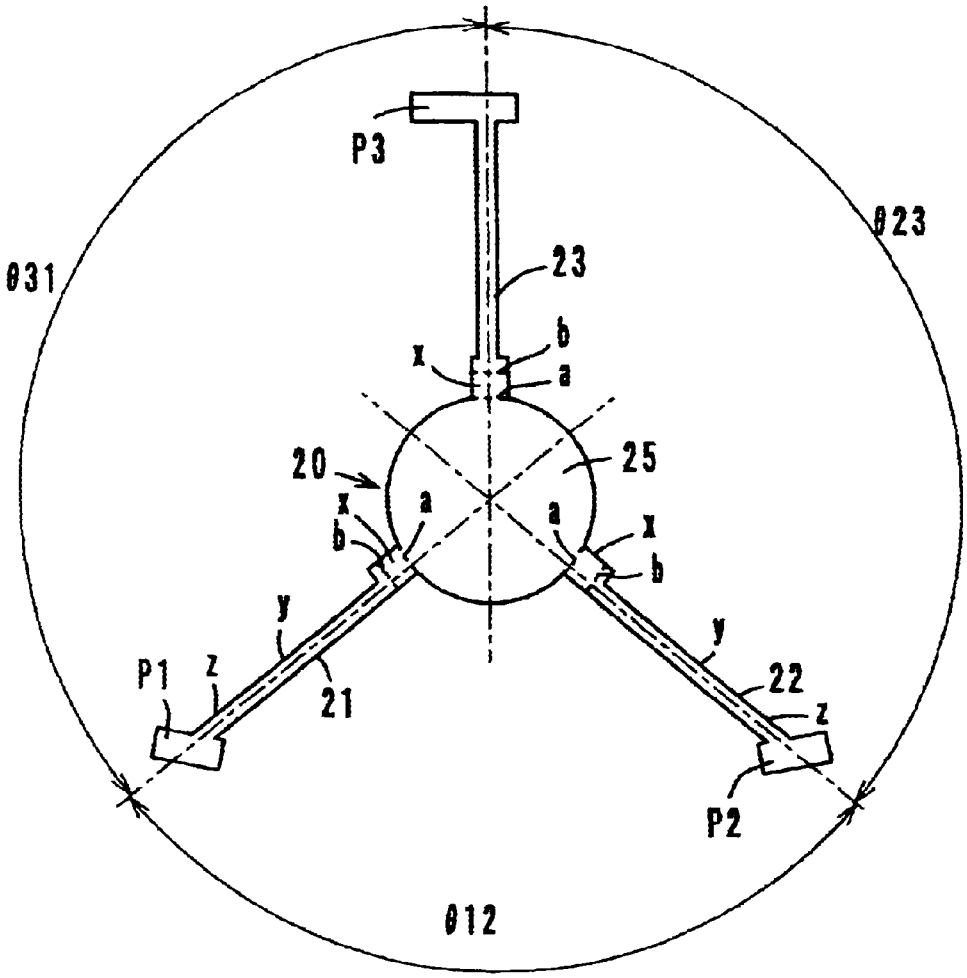
FIG. 8A is a development plan view of the electrode assembly of the center electrode assembly in accordance with a fifth embodiment of the present invention.
Figure 8B:
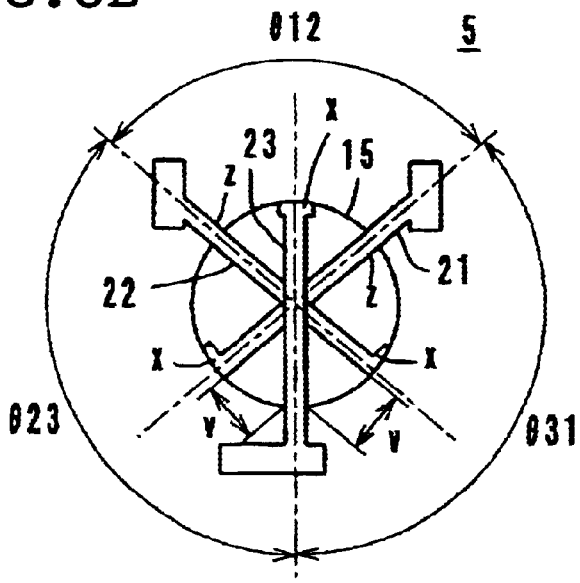
FIG. 8B is a plan view showing the state in which this electrode assembly and the ferrite have been assembled.

Fifth Embodiment, FIGS. 8A and 8B

A center electrode assembly 5 in accordance with a fifth embodiment is configured by setting the width of each of the center electrodes 21, 22, and 23, which are each formed of one conductor line as in the case of the first embodiment, to be larger at the ferrite edge portion x on the cold-end side than at the ferrite edge portion z on the hot-end side.

Moreover, in the fifth embodiment, letting the crossing angle formed between the center electrodes 21 and 22 be θ12, the crossing angle formed between the center electrodes 21 and 23 be θ31, and the crossing angle formed between the center electrodes 22 and 23 be θ23, the relationships θ12<θ31, and θ12<θ23 hold.

Also, the line width at the ferrite edge portion x on the cold-end side of the center electrode 21 constituting the port portion P1, expands toward the side of the center electrode 23 constituting the port portion P3, with respect to the center line at the ferrite center portion y of the center electrode 21. Likewise, the line width at the ferrite edge portion x on the cold-end side of the center electrode 22 constituting the port portion P2, expands toward the side of the center electrode 23 constituting the port portion P3, with respect to the center line at the ferrite center portion y of the center electrode 22.

The relationship between θ31 and θ23 may be θ31=θ23, or θ31≠θ23.

The crossing angle θ12 is not necessarily required to be 120°. In order to improve the insertion loss between the port portions P1 and P2, the relation 100°<θ12<120° is desirable. If the crossing angle θ12 is not larger than 100°, the insertion loss will deteriorate too much to be useful. On the other hand, if the crossing angle θ12 is larger than 120°, the isolation will deteriorate.

Also, when θ12<120°, the port impedance of the port portion P3 becomes lower than when θ12=120°, and hence, it is desirable to form the center electrode 23 constituting the port portion P3 using a single line, to increase the port impedance.

Other configurations of the fifth embodiment are the same as those of the above-described first embodiment, and the effects thereof also are fundamentally the same as those of the first embodiment. Furthermore, in the fifth embodiment, when the above-described electrode assembly 20 and the ferrite 15 are assembled into the center electrode assembly 5, the distance v between the center electrodes 21 and 23, and between the center electrodes 22 and 23 becomes larger, so that electric short circuits therebetween can be prevented.

Figure 9A:
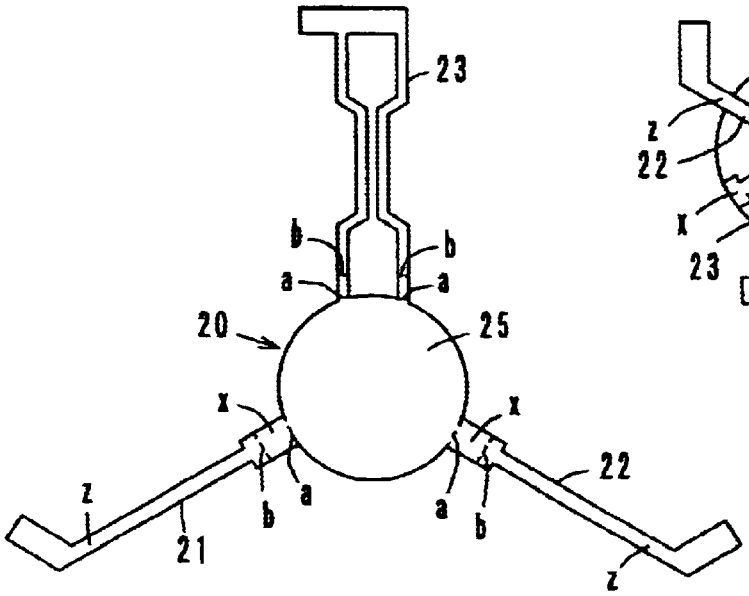
FIG. 9A is a development plan view of the electrode assembly of the center electrode assembly in accordance with a sixth embodiment of the present invention.
Figure 9B:
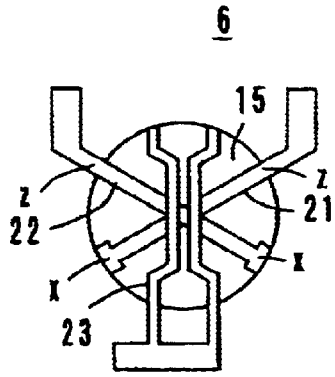
FIG. 9B is a plan view showing the state in which this electrode assembly and the ferrite have been assembled.

Sixth Embodiment, FIGS. 9A and 9B

A center electrode assembly 6 in accordance with a sixth embodiment is configured by bringing the lines of the center electrode 23, which is formed of two conductor lines, close together on the top surface of the ferrite 15, by partially bending them. Herein, the two lines of the center electrode 23 may be asymmetric with respect to each other around the center line of the center electrode 23.

The configuration, shape, and other configurations of each of the center electrodes 21 and 22, which are each formed of one conductor line, in accordance with the sixth embodiment, are the same as those of the above-described first embodiment. The effects thereof are also the same as those of the first embodiment.

A feature of this embodiment, setting the two conductor lines of a center electrode to be nonparallel or asymmetric with respect to each other, can also be applied to other embodiments besides the sixth embodiment.

Figure 10A:
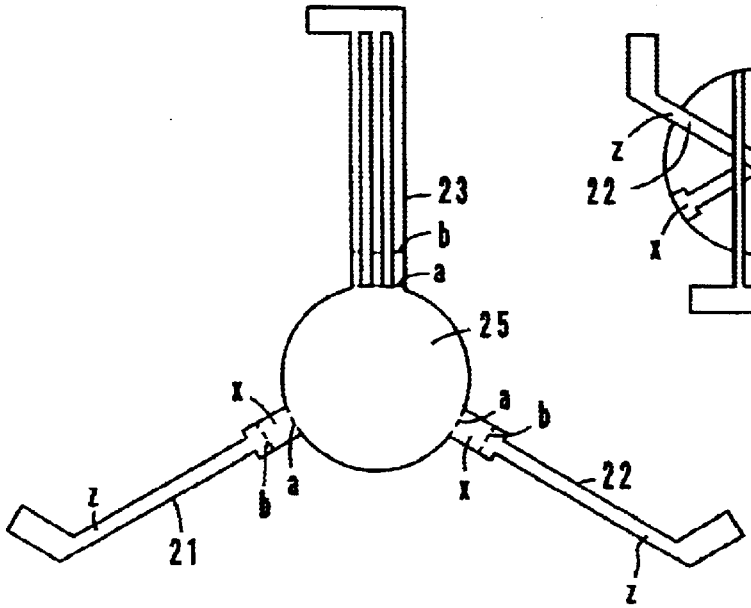
FIG. 10A is a development plan view of the electrode assembly of the center electrode assembly in accordance with a seventh embodiment of the present invention.
Figure 10B:
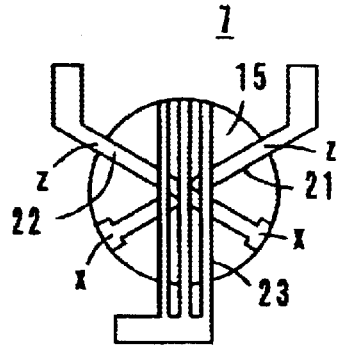
FIG. 10B is a plan view showing the state in which this electrode assembly and the ferrite have been assembled.

Seventh Embodiment, FIGS. 10A and 10B

A center electrode assembly 7 in accordance with a seventh embodiment is configured by forming the center electrode 23 constituting the port portion P3 using three conductor lines. Alternatively, however, the conductor lines of the center electrode 23 may be formed of more than three lines.

The configuration, shape, and other configurations of each of the center electrodes 21 and 22 formed of one conductor line, in accordance with the seventh embodiment, are the same as those of the above-described first embodiment. The effects thereof are also the same as those of the first embodiment. Forming the center electrode 23 using three or more conductor lines reduces the impedance thereof and can also be applied to other embodiments.

Figure 11A:
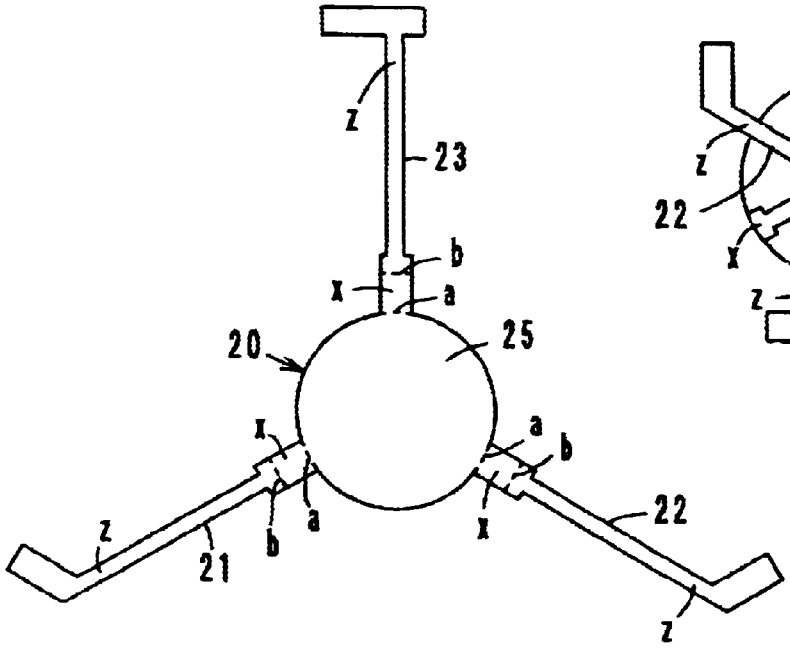
FIG. 11A is a development plan view of the electrode assembly of the center electrode assembly in accordance with an eighth embodiment of the present invention.
Figure 11B:
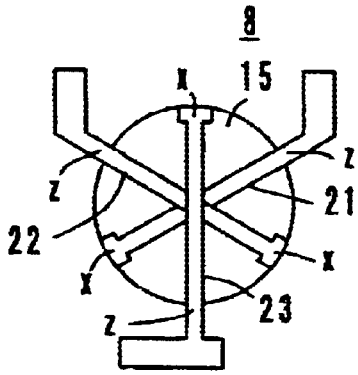
FIG. 11B is a plan view showing the state in which this electrode assembly and the ferrite have been assembled.

Eighth Embodiment, FIGS. 11A and 11B

A center electrode assembly 8 in accordance with an eighth embodiment is configured by forming each of the center electrodes 21, 22, and 23 using one conductor line, and by setting the width of each of the center electrodes 21, 22, and 23 to be partly larger at the ferrite edge portion x on the cold-end side, as in the case of the first embodiment.

Other configurations of the eighth embodiment are the same as those of the above-described first embodiment, and the effects thereof also are the same as those of the first embodiment.

Figure 12:
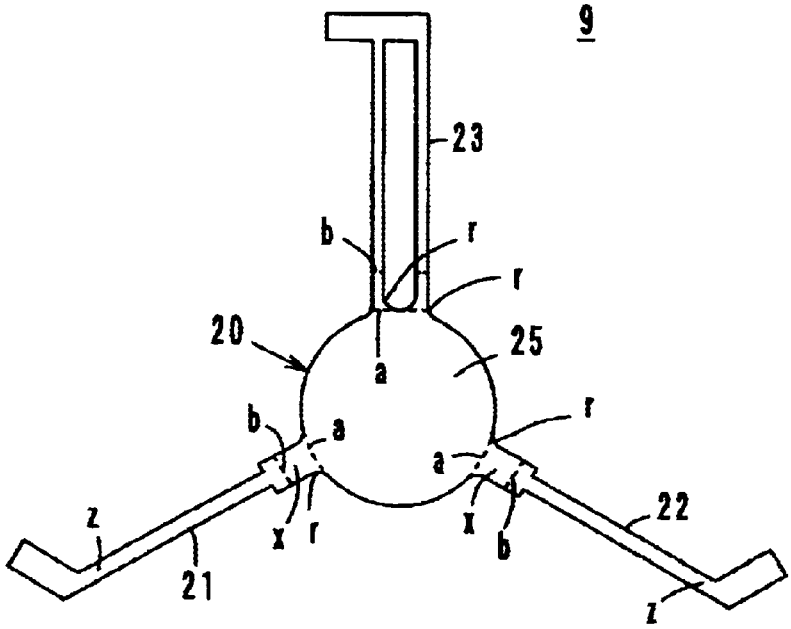
FIG. 12 is a development plan view of the electrode assembly of the center electrode assembly in accordance with a ninth embodiment of the present invention.

Ninth Embodiment, FIG. 12

A center electrode assembly 9 in accordance with a ninth embodiment is configured by forming each of the center electrodes 21, 22, and 23 so that the corners where the center electrodes join the center planar portion 25 have smooth continuous arc portions r.

Other configurations of the ninth embodiment are the same as those of the above-described first embodiment, and the effects thereof also are fundamentally the same as those of the first embodiment. Furthermore, in the ninth embodiment, by forming arcuate portions r at each of the root portions of the center electrodes 21, 22, and 23, the width of each of the folded portions "a" becomes larger, and thereby the stress concentration is more relaxed, so that the crossing angle becomes more stable. In addition, the risk of line breakage is eliminated with reliability.

Figure 13:
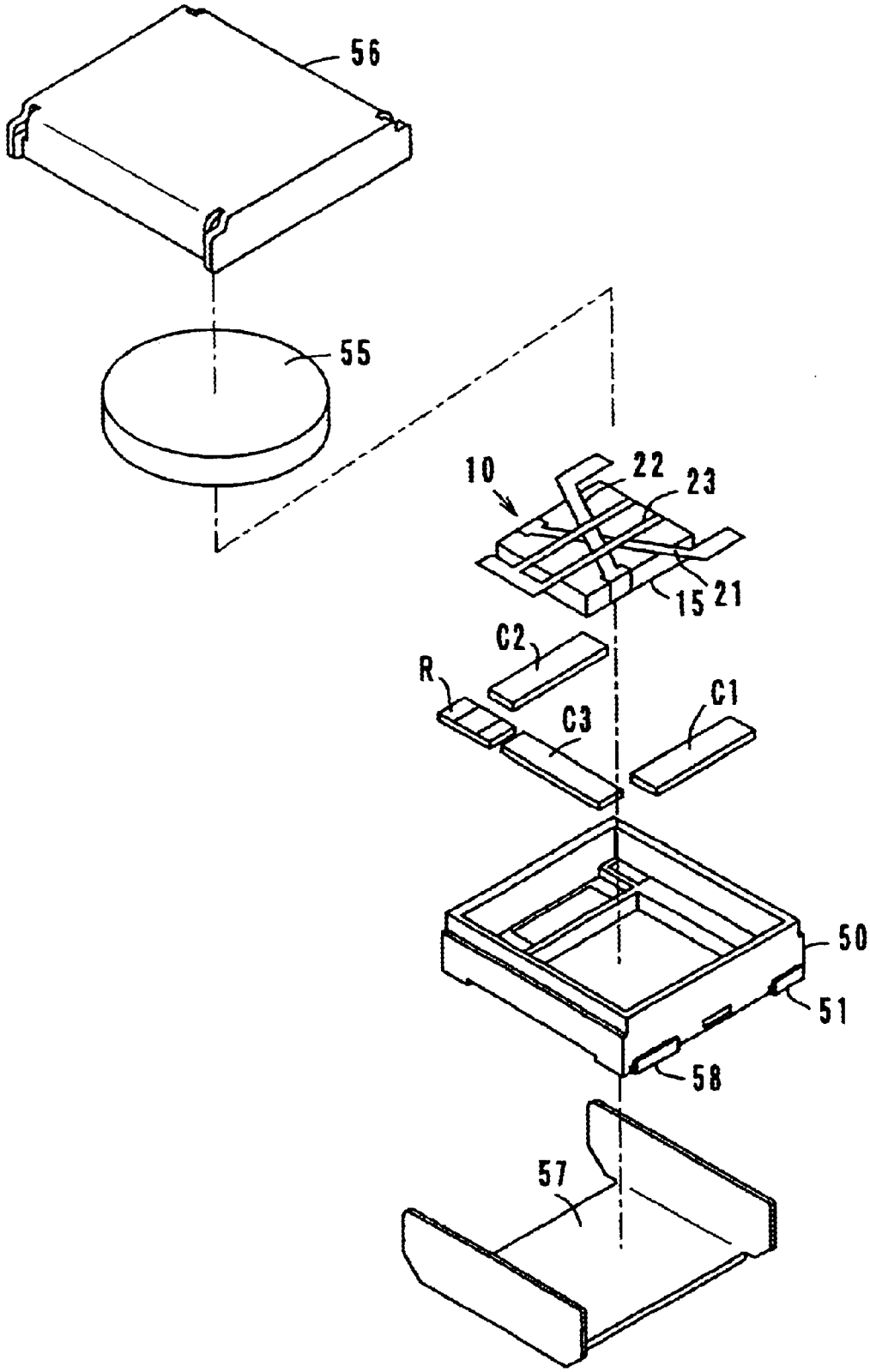
FIG. 13 is an exploded perspective view illustrating a nonreciprocal circuit device including the center electrode assembly in accordance with a tenth embodiment of the present invention.
Figure 14A:
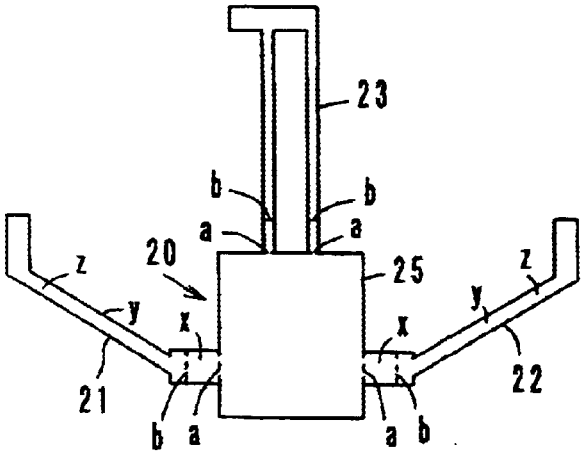
FIG. 14A is a development plan view of the electrode assembly of the center electrode assembly in accordance with the tenth embodiment.
Figure 14B:
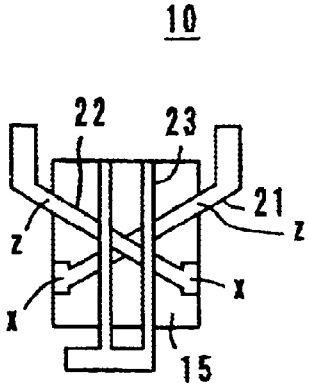
FIG. 14B is a plan view showing the state in which this electrode assembly and the ferrite have been assembled.

Tenth Embodiment, FIGS. 13, 14A, and 14B

FIG. 13 illustrates each of the components of a nonreciprocal circuit device (concentrated-constant type isolator) including the center electrode assembly 10 in accordance with the tenth embodiment. FIG. 14A is a development view of the electrode assembly 20, and FIG. 14B is a view of a center electrode assembly 10.

This nonreciprocal circuit device comprises fundamentally the same components as those of the nonreciprocal circuit device shown in FIG. 1. A ground terminal 58 and an input/output terminal 51 are provided on the resin case 50. The equivalent circuit of this embodiment is the same as that shown in FIG. 4.

As the ferrite 15, the center electrode assembly 10 uses a ferrite having a rectangular parallelepiped shape. The center planar portion 25 of the electrode plate 20, therefore, is formed so as to fit the rectangular parallelepiped shape of the ferrite 15. Each of the center electrode 21 and 22 is formed of one conductor line, while the center electrode 23 is formed of two conductor lines. As in the case of the above-described first embodiment, the line width of each of the center electrodes 21 and 22 is set to be partly larger at the ferrite edge portion x on the cold-end side than at the ferrite center portion y and at the ferrite edge portion z on the hot-end side. The widened portion includes folded portions "a" and "b".

Other configurations of the tenth embodiment are the same as those of the above-described first embodiment except that the tenth embodiment uses a ferrite having a rectangular parallelepiped shape as the ferrite 15, and the effects thereof also are the same as those of the first embodiment.

Figure 15A:
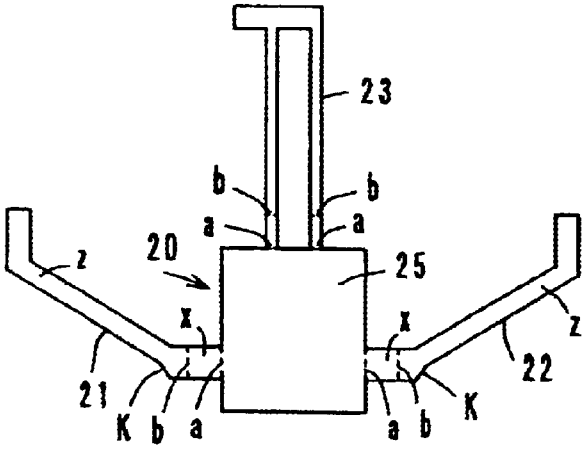
FIG. 15A is a development plan view of the electrode assembly of the center electrode assembly in accordance with an eleventh embodiment of the present invention.
Figure 15B:
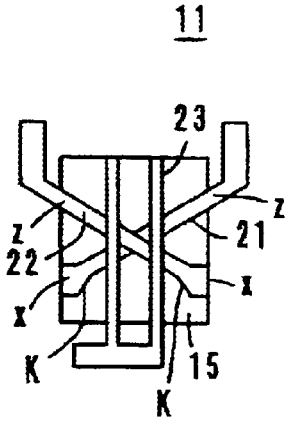
FIG. 15B is a plan view showing a state in which this electrode assembly and the ferrite have been assembled.

Eleventh Embodiment, FIGS. 15A and 15B

A center electrode assembly 11 in accordance with an eleventh embodiment is configured by providing angled portions K at the positions where the widely-formed ferrite edge portions x on the cold-end sides of the center electrodes 21 and 22 are connected to the rest of the center electrodes 21 and 22.

Other configurations of the eleventh embodiment are the same as those of the above-described tenth embodiment, and the effects thereof also are fundamentally the same as those of the tenth embodiment. Furthermore, in the eleventh embodiment, providing the above-described angled portions K eliminates step differences in the vicinities of the folded portions "b", thereby relaxing the stress concentration.

Figure 16:
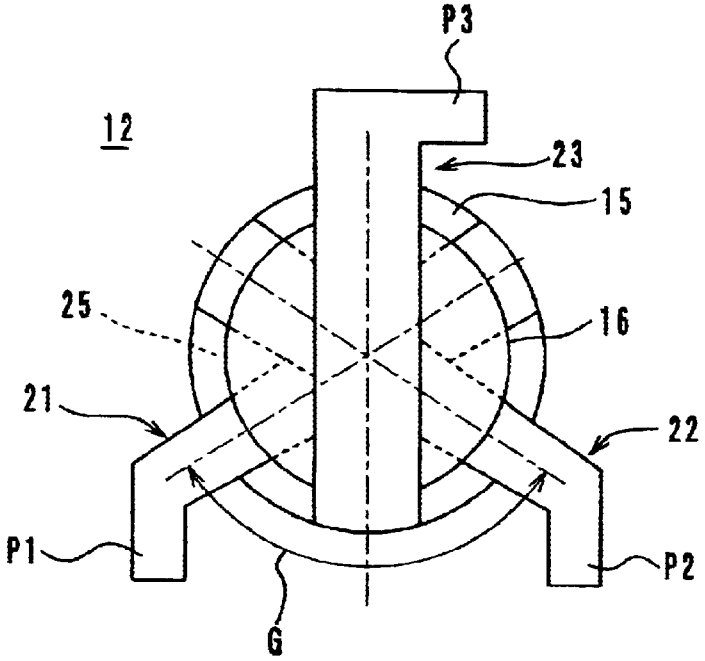
FIG. 16 is a plan view illustrating the center electrode assembly in accordance with a twelfth embodiment of the present invention.
Figure 17:
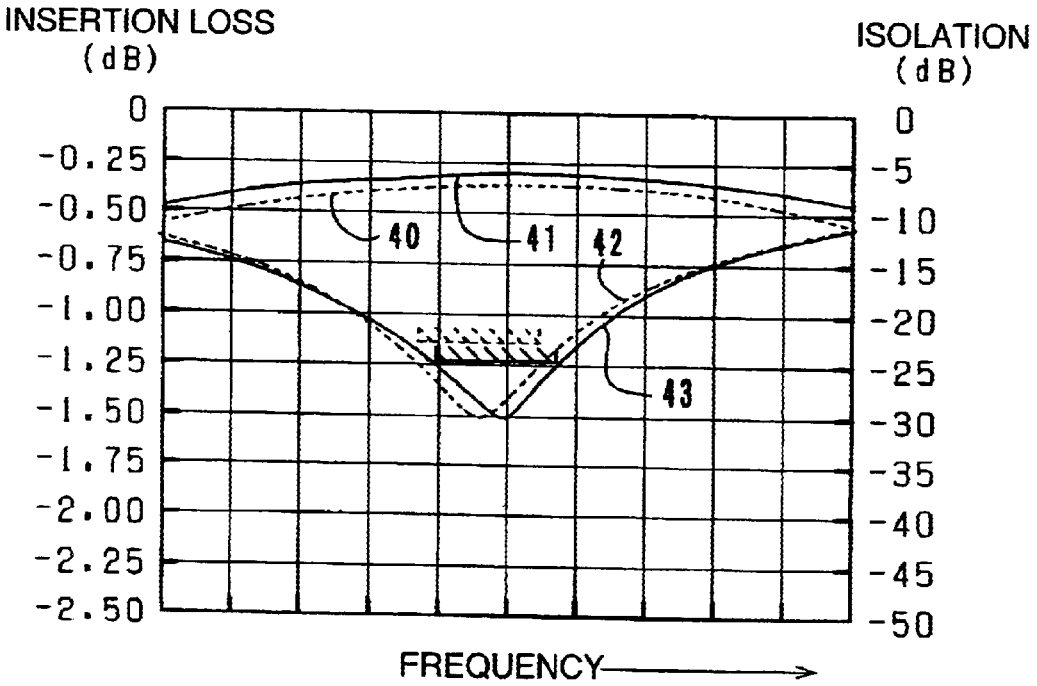
FIG. 17 is a diagram illustrating the relationship between the insertion loss and the isolation characteristic of the center electrode assembly shown in FIG. 16.

Twelfth Embodiment, FIGS. 16 and 17

FIG. 16 illustrates a center electrode assembly 12 in accordance with a twelfth embodiment of the present invention. In the center electrode assembly 12, on the top surface (first main surface) of a microwave ferrite 15 having a circular shape in a plan view, an input center electrode 21, an output center electrode 22, and a terminal center electrode 23 are arranged with substantially circular insulating sheets 16 interposed thereamong so that the crossing angle G formed between the input center electrode 21 and the output center electrode 22 becomes 125°. The terminal center electrode 23 is crossed with the input center electrode 21 and the output center electrode 22 so as to be positioned between the input center electrode 21 and the output center electrode 22. The center electrodes 21, 22, and 23, are stacked on the top surface of the ferrite 15, with the input center electrode 21, an insulating sheet 16, the output center electrode 22, an insulating sheet 16, and the terminal center electrode 23, stacked in this order.

The input center electrode 21, the output center electrode 22, and the terminal center electrode 23 have port portions P1, P2, and P3 at first ends thereof, respectively, and a ground electrode (center planar portion) 25 is connected to the other ends thereof. The ground electrode 25 common to the center electrodes 21, 22, and 23 is provided so as to cover substantially over the entire bottom surface (second main surface) of the ferrite 15. The input center electrode 21 and the output center electrode 22 have shapes with gradually-increasing width wherein the electrode widths at the ground electrode side are larger than those at the port portions P1 and P2, respectively. More specifically, the input center electrode 21 and the output center electrode 22 are formed so as to extend divergently from the respective port portions P1 and P2 toward the ground electrode.

The input center electrode 21 and the output center electrode 22, the terminal center electrode 23, and the ground electrode 25 are constituted of conductive materials such as Ag, Cu, Au, Al, and Be, and integrally formed by stamping out or by etching a thin metallic plate constituted of such a material.

In this manner, a center electrode assembly 12 is obtained. In the center electrode assembly 12, since the input center electrode 21 and the output center electrode 22 have gradually-increasing widths wherein the electrode widths at the ground electrode are larger than those at the port portions P1 and P2, respectively, the concentration degree of high-frequency current at the ground electrode, which generally exhibits the largest high-frequency currents, is relaxed. As a result, even if the crossing angle G formed between the input center electrode 21 and the output center electrode 22 is enlarged, the insertion loss can be reduced without reducing the isolation bandwidth of the isolator in which the center electrode assembly 12 has been incorporated.

FIG. 17 illustrates the insertion losses and isolation characteristics of the isolator incorporating the center electrode assembly 12 wherein the crossing angle G formed between the input center electrode 21 and the output center electrode 22 is 125°, and the conventional isolator having the center electrode assembly 240 (FIG. 31), wherein the crossing angle G formed between the input center electrode and the output center electrode is 120°. Here, the solid line 41 indicates the insertion loss of the isolator with the center electrode assembly 12 wherein the crossing angle G formed between the input center electrode 21 and the output center electrode 22 is 125°, and the solid line 43 indicates the isolation characteristic thereof. On the other hand, the dotted line 40 indicates the insertion loss of the conventional isolator with the center electrode assembly 240 having a crossing angle G of 120°, and the dotted line 42 indicates the isolation characteristic thereof. It can be seen from FIG. 17 that, for the isolation bandwidth, the above-described two cases show substantially the same result, but for the insertion loss, the case using the center electrode assembly 12 in accordance with the twelfth embodiment exhibits a value smaller than the case using the conventional center electrode assembly 240.

Furthermore, since the electrode width on the side of the ground electrode 25, which is the root of the input center electrode 21 and the output center electrode 22, is large, the shakiness of the center electrodes 21, 22, and 23 can be stabilized. This eliminates the variations in the characteristic from one production lot to another, thereby reducing the variations in the characteristic of the center electrode assembly 12.

Modifications of Twelfth Embodiment, FIGS. 18 to 21

Apart from the example shown in FIG. 16, the widths and the shapes of the center electrodes 21, 22, and 23 may be variously modified.

Figure 18:
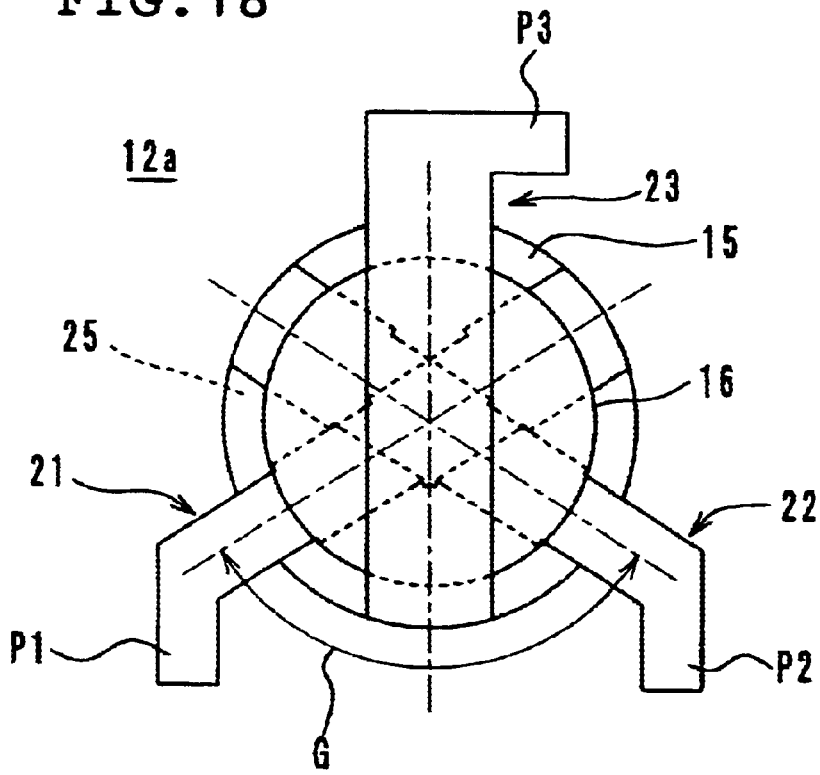
FIG. 18 is a plan view illustrating a modification of the center electrode assembly shown in FIG. 16.

For example, as shown in FIG. 18, the input center electrode 21 and the output center electrode 22 may extend stepwise toward the ground electrode 25, and thereby may have shapes with gradually-increasing widths wherein the electrode widths at the ground electrode 25 are larger than those at the port portions P1 and P2.

Figure 19:
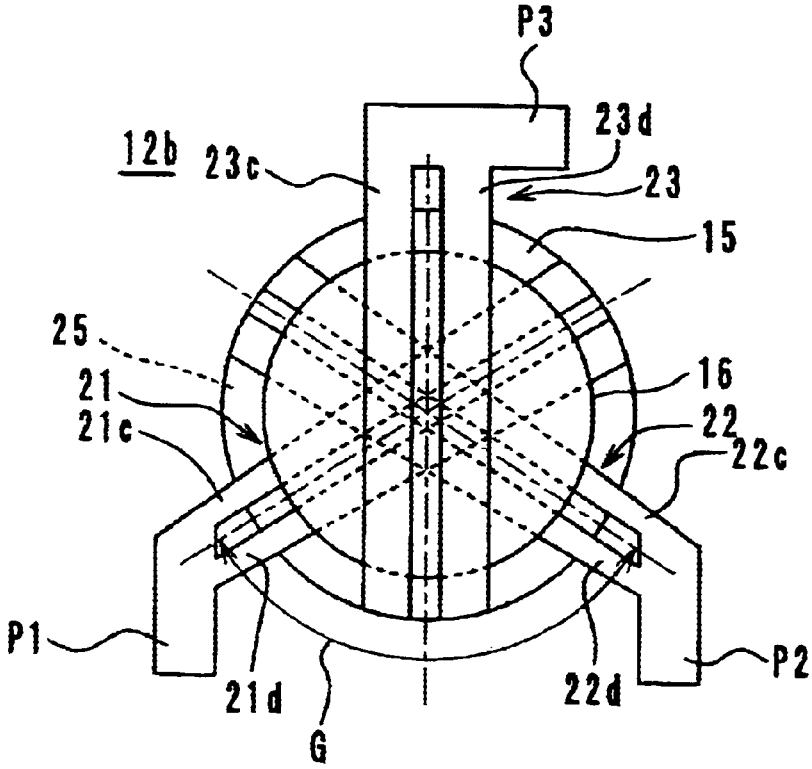
FIG. 19 is a plan view illustrating another modification of the center electrode assembly shown in FIG. 16.

Also, as shown in FIG. 19, the center electrodes 21, 22, and 23 may be formed of two conductor lines 21*c* and 21*d*; 22*c* and 22*d*; and 23*c* and 23*d*, respectively.

Figure 20:
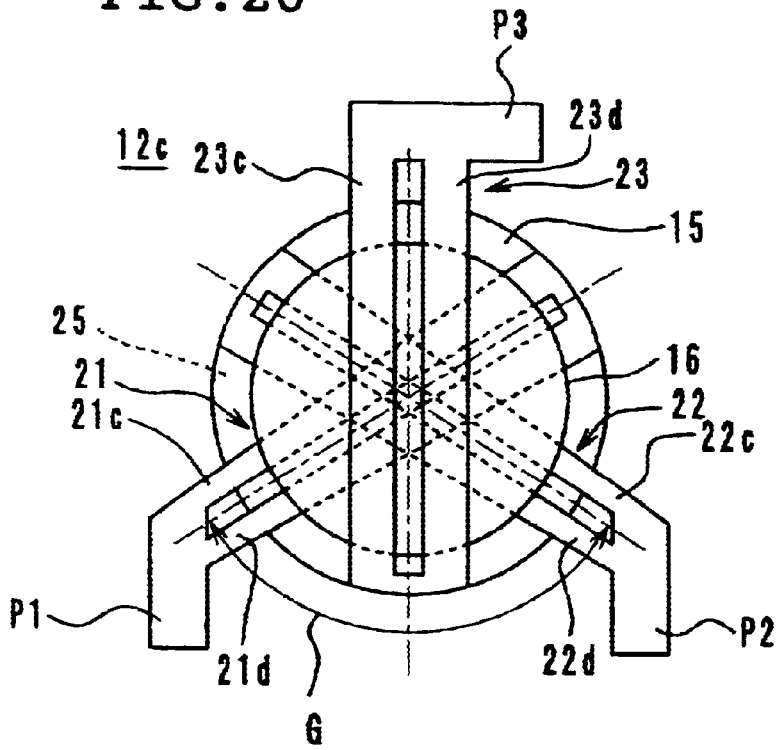
FIG. 20 is a plan view illustrating still another modification of the center electrode assembly shown in FIG. 16.

Furthermore, as shown in FIG. 20, the center electrodes 21, 22, and 23 may have respective slots which divide them into two conductor lines 21*c* and 21*d*; 22*c* and 22*d*; and 23*c* and 23*d*, respectively, over part of their length. At other parts of their length, the center electrodes 21, 22 and 23 have no slot and so are unitary. In the case of FIG. 20, the slot extends from the port portions P1 and P2, to near the ground electrode 25.

Figure 21:
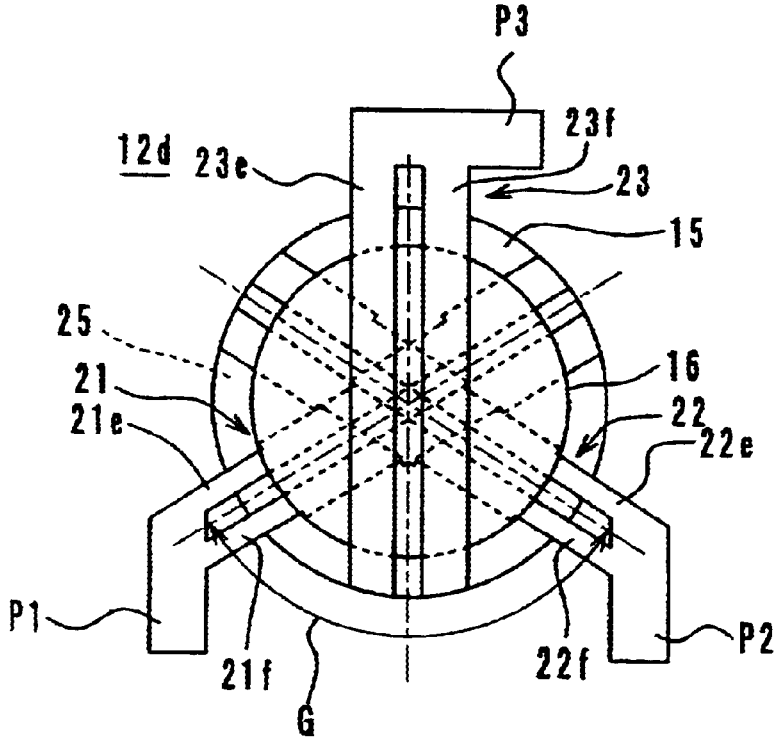
FIG. 21 is a plan view illustrating a further modification of the center electrode assembly shown in FIG. 16.

Moreover, as shown in FIG. 21, the center electrodes 21, 22, and 23 may be formed of two conductor lines 21*e* and 21*f*; 22*e* and 22*f*; and 23*e* and 23*f*, respectively, and these conductor lines 21*e* and 21*f*; 22*e* and 22*f*; and 23*e* and 23*f* may become wider stepwise as they extend from the port portions P1 and P2 toward the ground electrode 25.

Figure 22:
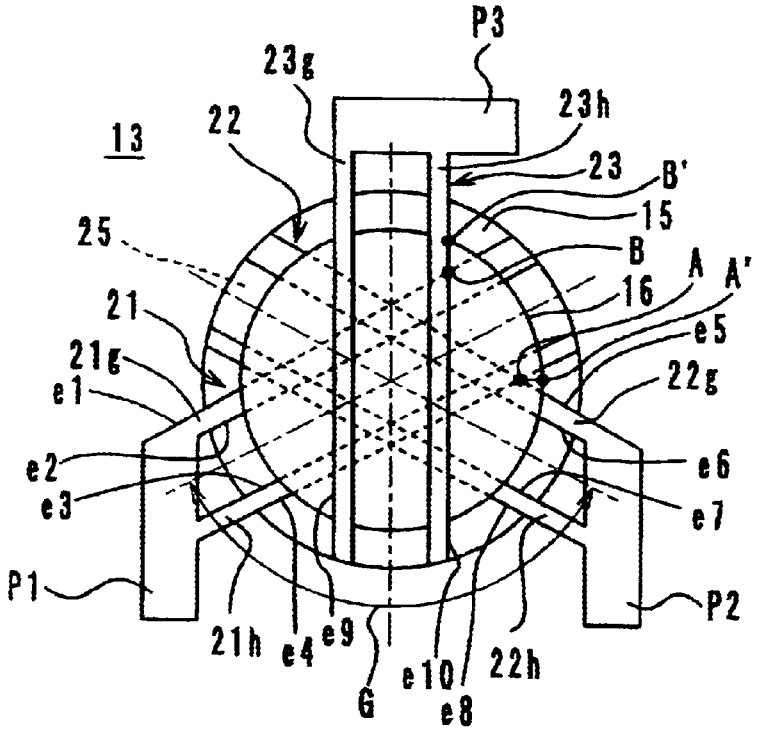
FIG. 22 is a plan view illustrating the center electrode assembly in accordance with a thirteen embodiment of the present invention.

Thirteenth Embodiment, FIG. 22

FIG. 22 illustrates a center electrode assembly 13 in accordance with a thirteenth embodiment of the present invention. In the center electrode assembly 13, on the top surface of a microwave ferrite 15, an input center electrode 21, an output center electrode 22, and a terminal center electrode 23 are arranged so as to intersect one another, with insulating sheets 16 interposed thereamong. The crossing angle G formed between the input center electrode 21 and the output center electrode 22 is 122°. The center electrodes 21, 22, and 23 are formed of two conductor lines 21*g* and 21*h*; 22*g* and 22*h*; and 23*g* and 23*h*, respectively. In the center electrodes 21, 22, and 23, first ends thereof are used as port portions P1, P2, and P3, respectively, and a ground electrode 25 is connected to the other ends thereof. The ground electrode 25 common to the center electrodes 21, 22, and 23 is provided so as to cover substantially the entire bottom surface of the ferrite 15.

Figure 31:
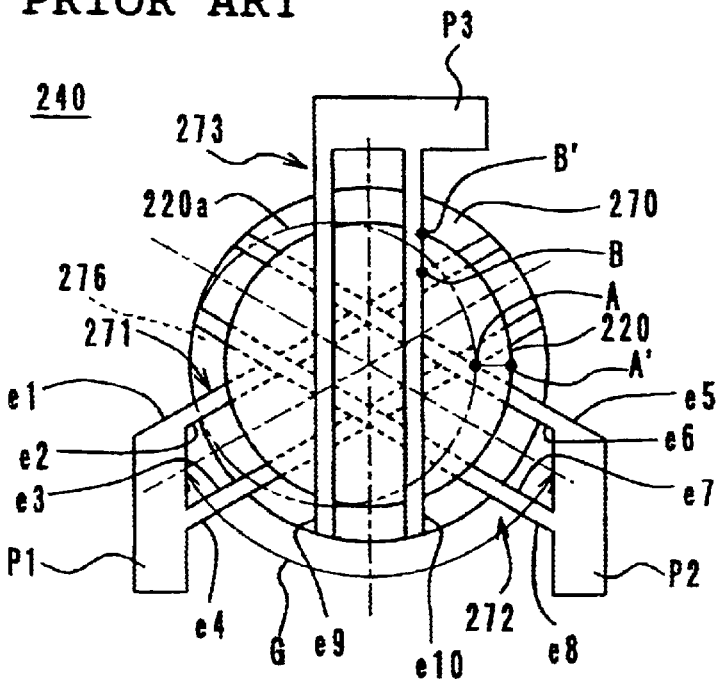
FIG.31 PRIOR ART
FIG. 31 is a plan view illustrating another conventional center electrode assembly.
Figure 32:
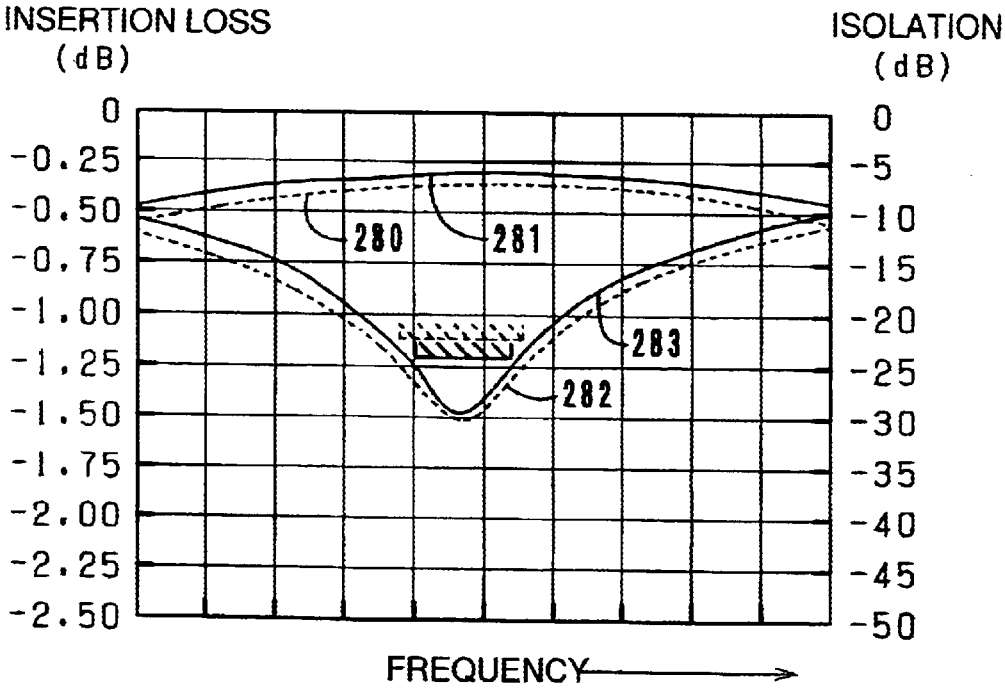
FIG.32 PRIOR ART
FIG. 32 is a diagram illustrating the relationship between the insertion loss and the isolation of the conventional center electrode assembly shown in FIG. 31.

In the conventional center electrode assembly 240 shown in FIG. 31, if the crossing angle G formed from the input center electrode 271 and the output center electrode 272 is made larger than 120°, the distance B–B' from the intersection point B of the edge e1 of the input center electrode 271 and the edge e10 of the terminal center electrode 273 to the edge portion of the insulating sheets 220, becomes larger than the distance A–A' from the intersection point A of the edge e4 of the input center electrode 271 and the edge e5 of the output center electrode 272 to the edge portion of the insulating sheets 220.

Accordingly, in the thirteen embodiment, by utilizing the larger distance B–B', in other words, the larger insulation distance between the center electrodes, the electrode width of each of the input center electrode 21 and the output center electrode 22 is enlarged. Specifically, by extending, in the electrode width direction, the edges e1 and e5 of the conductor lines 21*g* and 22*g* of the input center electrode 21 and the output center electrode 22, which edges e1 and e5 are the closest to the terminal port portion P3, the input center electrode 21 and the output center electrode 22 are formed so as to have shapes in which their widths gradually increase on one side, wherein the electrode widths on the ground electrode 25 side are larger than those nearer the port portions P1 and P2, respectively.

More specifically, the edge e2 of the conductor line 21*g* of the input center electrode 21, and the edges e3 and e4 on both sides of the conductor line 21*h* are formed so as to be parallel to one another. Further, the edge e1 closest to the terminal port portion P3 is extended in the electrode width direction, until the distance B–B' from the intersection point B of the edge e1 of the input center electrode 21 and the edge e10 of the terminal center electrode 23 to the edge portion of the insulating sheets 16 becomes equal to the distance A–A' from the intersection point A of the edge e4 of the input center electrode 21 and the edge e5 of the output center electrode 22 to the edge portion of the insulating sheets 16.

Likewise, the edge e6 of the conductor line 22*g* of the output center electrode 22, and the edges e7 and e8 on both sides of the conductor line 22*h* are formed so as to be parallel to one another. Further, the edge e5 closest to the terminal port portion P3 is extended in the electrode width direction, until the distance from the intersection point of the edge e5 of the output center electrode 22 and the edge e9 of the terminal center electrode 23 to the edge portion of the insulating sheets 16 becomes equal to the distance from the intersection point of the edge e8 of the output center electrode 22 and the edge e1 of the input center electrode 21 to the edge portion of the insulating sheets 16.

In the above-described center electrode assembly 13, by extending the edges e1 and e5 closest to the terminal port portion P3, in the electrode width direction, the short-circuit failures among the center electrodes 21, 22, and 23 due to the displacement of the insulating sheets 16 can be more suppressed than in the case of the center electrode assembly 12 in accordance with the above-described the twelfth embodiment.

Furthermore, since the electrode width on the side of the ground electrode 25, which is the root of the input center electrode 21 and the output center electrode 22, is large, the crossing angle G formed among the center electrodes 21, 22, and 23 can be stabilized, thereby reducing the variations in characteristic of the center electrode assembly 13.

Figure 23:
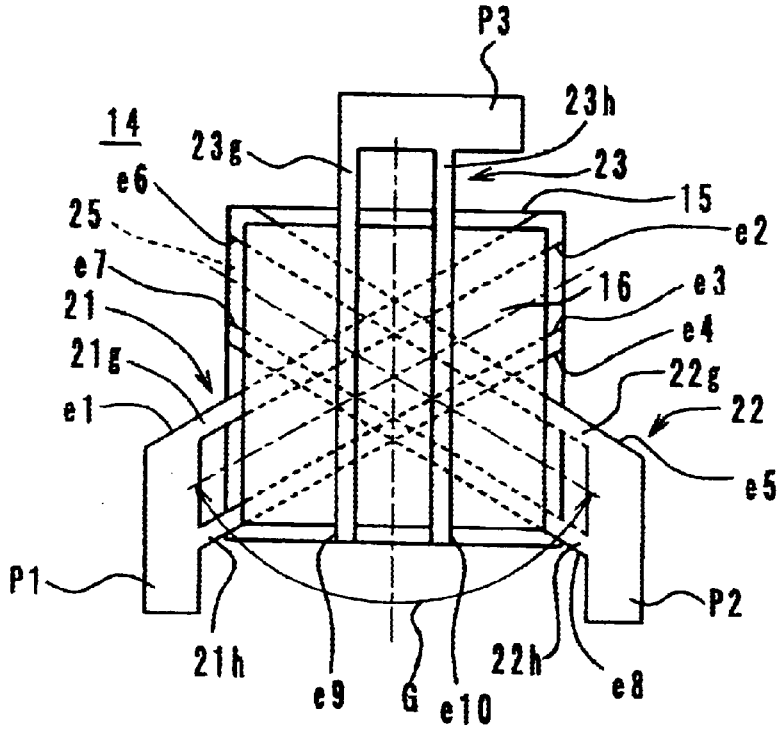
FIG. 23 is a plan view illustrating the center electrode assembly in accordance with a fourteen embodiment of the present invention.

Fourteenth Embodiment, FIG. 23

FIG. 23 illustrates a center electrode assembly 14 in accordance with a fourteenth embodiment of the present invention. In the center electrode assembly 14, a ferrite 15 having a rectangular shape in a plan view is used. By extending, in the electrode width direction, the edges e1 and e5 of the conductor lines 21*g* and 22*g* of the input center electrode 21 and the output center electrode 22, closest to the terminal port portion P3, the input center electrode 21 and the output center electrode 22 are formed so as to have shapes which gradually increase in width on one side, wherein the electrode widths on the ground electrode 25 side are larger than those near the port portions P1 and P2, respectively.

In the center electrode assembly 14, by enlarging the width on the side of the ground electrode 25, which is the root of the conductor lines 21*g* and 21*h*; and 22*g* and 22*h* of the center electrodes 21 and 22, the crossing angle G formed between the center electrodes 21 and 22 can be stabilized, so that the variations in characteristic of the center electrode assembly 14 can be more reduced.

Figure 24:
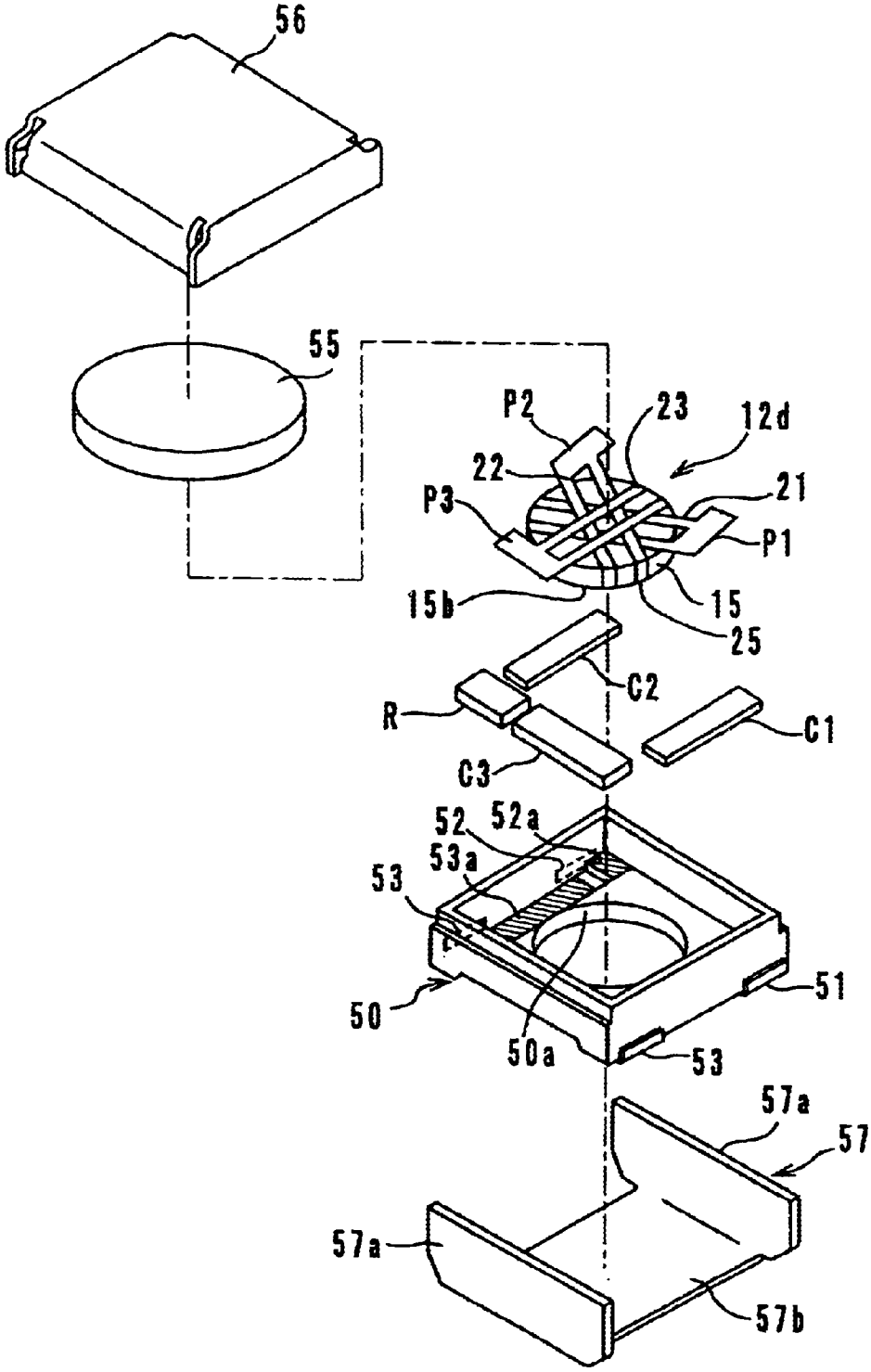
FIG. 24 is an exploded perspective view illustrating the nonreciprocal circuit device in accordance with an embodiment of the present invention.
Figure 25:
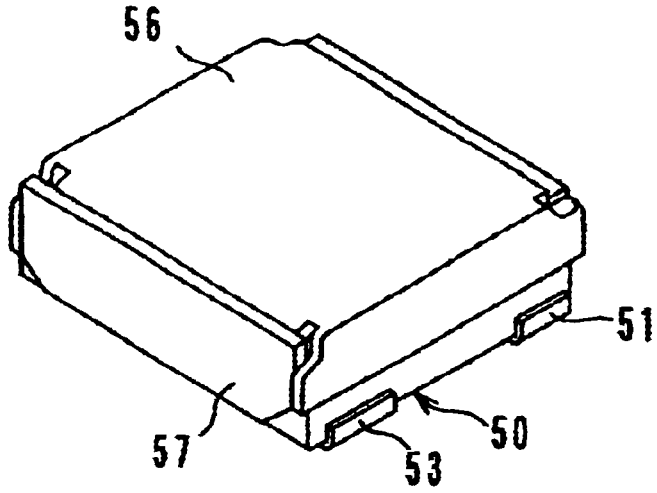
FIG. 25 is an external perspective view illustrating the nonreciprocal circuit device shown in FIG. 24.

Embodiment of Nonreciprocal Circuit Device, FIGS. 24 and 25

FIG. 24 illustrates each of the components of a nonreciprocal circuit device in accordance with an embodiment of the present invention, and FIG. 25 shows the appearance after assembling these components. This nonreciprocal circuit device is a concentrated-constant type isolator, and has the above-described center electrode assembly 12 incorporated therein.

As shown in FIG. 24, the nonreciprocal circuit device (concentrated-constant type isolator) comprises a metallic lower case 57, a resin terminal case 50, the above-described center electrode assembly 12*d*, a metallic upper case 56, a permanent magnet 55, a resistor element R, matching capacitors C1, C2 and C3, etc.

In the center electrode assembly 12*d*, the ground electrode 25 disposed on the back surface 15*b* of a ferrite 15 is connected to the bottom wall 57*b* of the metallic lower case 57 through the window 50*a* of the resin terminal case 50 by means of soldering or the like, and grounded.

In the resin terminal case 50, an input terminal 51, an output terminal 52, and ground terminals 53 are insert-molded. In the output terminal 52, one end thereof is exposed to the outside wall of the resin terminal case 50, and the other end thereof is exposed to the inside surface of the resin terminal case 50, thereby forming an output lead-out electrode portion 52*a*. In the input terminal 51, one end thereof is exposed to the outside wall of the resin terminal case 50, and the other end thereof is exposed to the inside surface of the resin terminal case 50, thereby forming an input lead-out electrode portion (not shown). Likewise, in each of the two ground terminals 53, one end thereof is exposed to one of the opposite outside walls of the resin terminal case 50, and the other end thereof is exposed to one of the inside surfaces of the resin terminal case 50, thereby forming a ground lead-out electrode portion 53*a*.

In the matching capacitors C1, C2, and C3, the hot-side capacitor electrodes thereof are electrically connected to the port positions P1, P2, and P3, respectively, and the cold-side capacitor electrodes thereof are electrically connected to the ground lead-out electrode portion 53*a*, which is exposed to the inside surface of the resin terminal case 50.

The resistor element R is constructed by forming electrodes on both end portions of an insulative substrate by means of thick-film printing or the like, and by disposing, between both end portions, a resistor such as a cermet-based, carbon-based, or ruthenium-based thick film, or a metallic thin-film. As the material for an insulative substrate, for example, a dielectric ceramic such as alumina is used. Also, a coating such as glass may be formed on the surface of the resistor.

One of the electrodes of the resistor element R is connected to the hot-side capacitor electrode of the matching capacitor element C3, and the other of the electrodes is connected to the ground lead-out electrode portion 53*a*. In other words, the matching capacitor element C3 and the resistor element R are electrically connected in parallel between the port portion P3 of the center electrode assembly 12*d* and ground.

The metallic lower case 57 has right and left side walls 57*a* and a bottom wall 57*b*. On the metallic lower case 57, the resin terminal case 50 is disposed. In the resin terminal case 50, the center electrode assembly 12*d* and the matching capacitor C1, C2, and C3 are accommodated, and the metallic upper case 56 is mounted on the metallic lower case 57. The permanent magnet 55 is adhered to the bottom surface of the metallic upper case 56, and adapted to apply a DC magnetic field to the center electrode assembly 12*d*. The metallic lower case 57 and the metallic upper case 56 constitute a magnetic circuit, and also serve as yoke portions. Each of the metallic lower case 57 and the metallic upper case 56 is formed by stamping out a plate material having a high permittivity, such as Fe or silicon steel, and by plating the surface of the stamped plate with Cu or Ag after bending.

In this manner, a nonreciprocal circuit device (concentrated-constant type isolator) as shown in FIG. 25 is obtained. The electrical equivalent circuit of this concentrated-constant type isolator is that shown in FIG. 4. Since this concentrated-constant type isolator is provided with the center electrode assembly 12*d* having the above-described features, it has low variation in its characteristics, small insertion loss, and sufficient isolation bandwidth.

For this concentrated-constant type isolator, the center electrode assemblies shown in the above-described embodiments, or the like may be used, besides the above-described center electrode assembly 12*d*.

Figure 26:
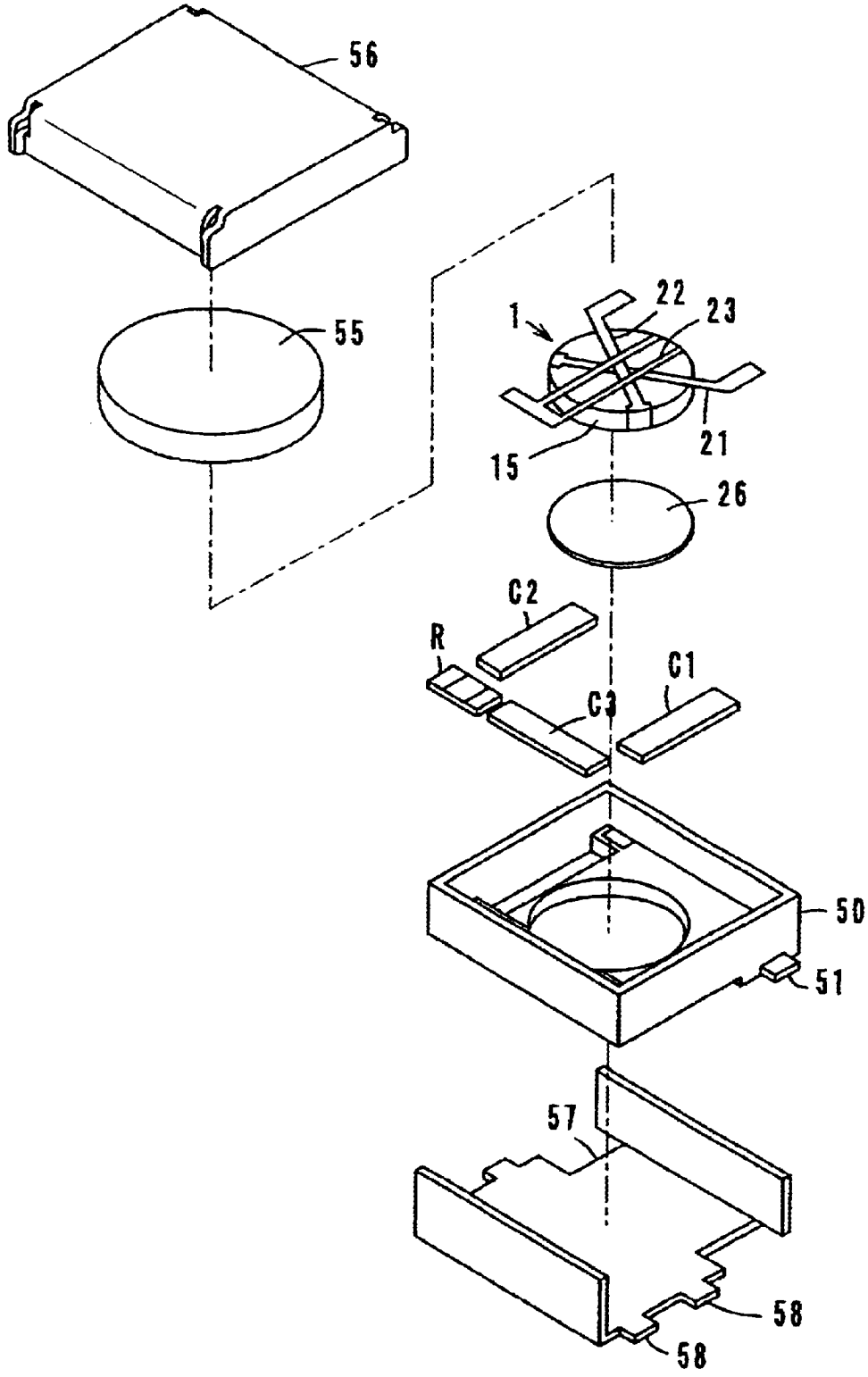
FIG. 26 is an exploded perspective view illustrating another nonreciprocal circuit device including the center electrode assembly in accordance with the above-described first embodiment.
Figure 27:
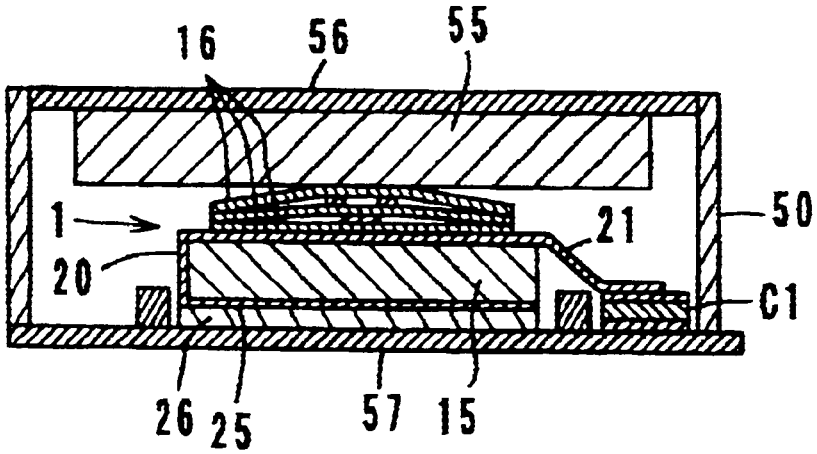
FIG. 27 is a sectional view illustrating the internal construction of the nonreciprocal circuit device shown in FIG. 26.
Figure 28:
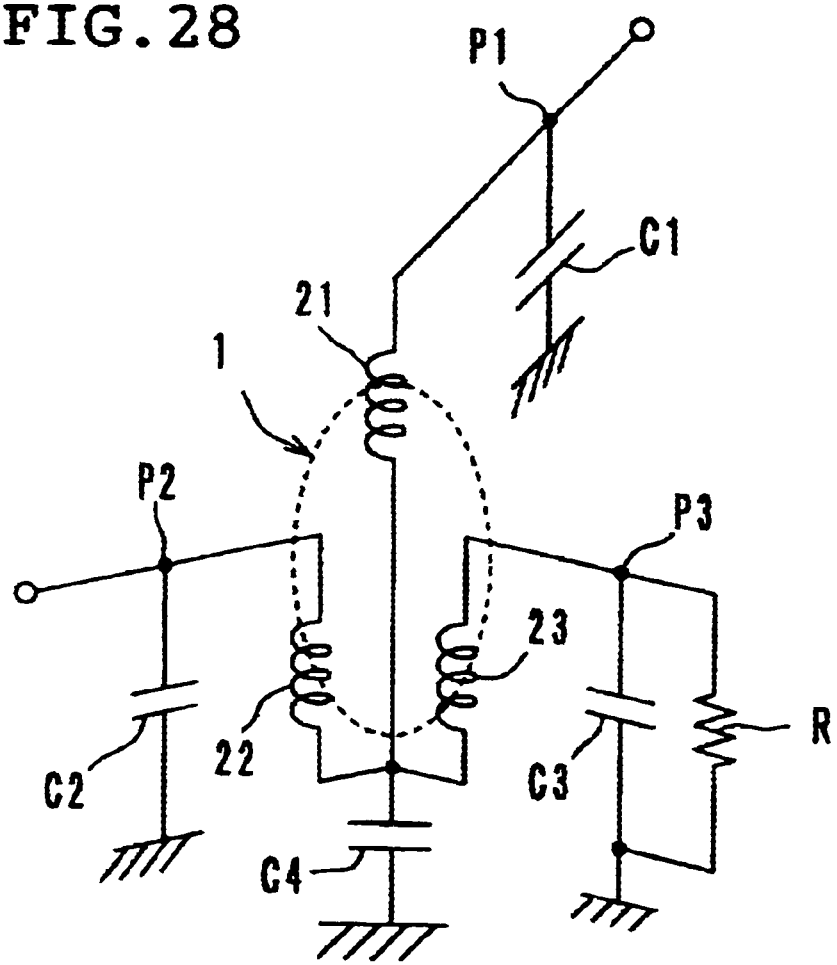
FIG. 28 is an electrical equivalent circuit of the nonreciprocal circuit device shown in FIG. 26.

Other Embodiments of Nonreciprocal Circuit Devices, FIGS. 26, 27, and 28

FIG. 26 illustrates each of the components of a nonreciprocal circuit device (concentrated-constant type isolator) in accordance with another embodiment of the present invention, which includes the center electrode assembly 1 explained as the above-described first embodiment and a dielectric sheet (polyimide sheet) 26 serving as a capacitor element, and FIG. 27 is a sectional view showing the appearance after assembling these components. Also, FIG. 28 shows the equivalent circuit of this nonreciprocal circuit device.

This nonreciprocal circuit device is configured by inserting the dielectric sheet 26 between the center planar portion 25 of the center electrode assembly 1 (the details thereof are the same as the first embodiment shown in FIGS. 3A and 3B) and the lower metallic case 57 in order to form a capacitor element C4 as shown in FIG. 28. In this nonreciprocal circuit device, therefore, the center planar portion 25 of the electrode plate 20 does not perform the function of a ground electrode.

The addition of the capacitor element C4 can be applied to any nonreciprocal circuit device having one of the center electrode assemblies described above.

Figure 29:
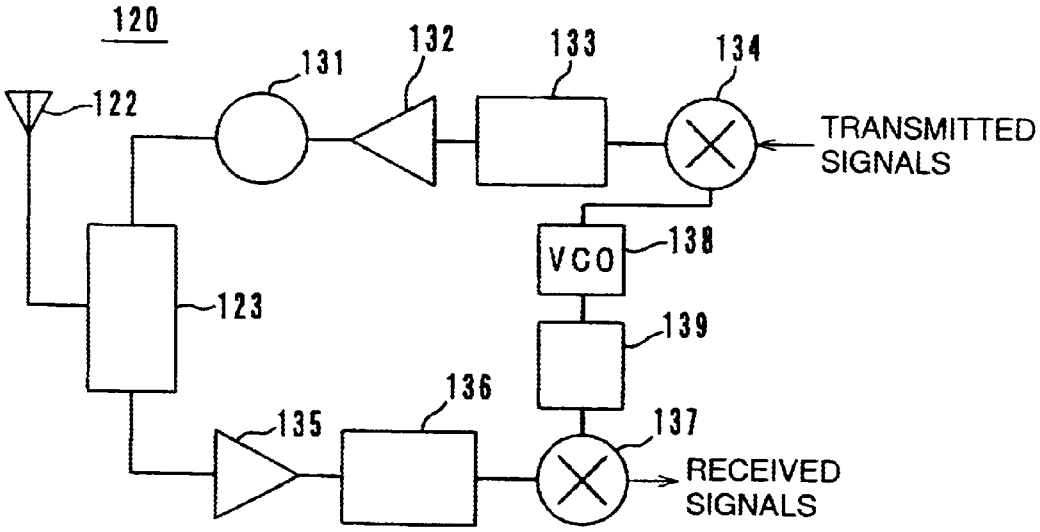
FIG. 29 is a block diagram showing the electrical circuit of a communication apparatus (mobile telephone) in accordance with the present invention.
Figure 30A:
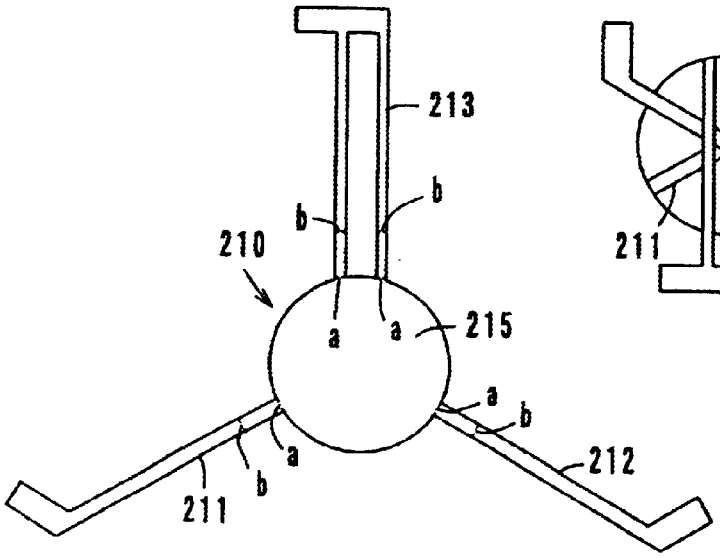
FIG.30A PRIOR ART
FIG. 30A is a development plan view of the electrode assembly of a conventional center electrode assembly.
Figure 30B:
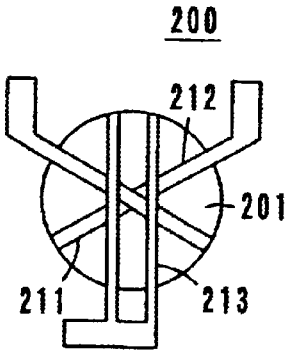
FIG.30B PRIOR ART
FIG. 30B is a plan view showing a state in which this electrode assembly and a ferrite have been assembled.

Communication Apparatus, FIG. 29

Next, as an embodiment of a communication apparatus in accordance with the present invention, a mobile telephone will be described by way of example. FIG. 29 illustrates the electric circuit 120 in the RF portion of the mobile telephone. Reference numeral 122 denotes an antenna element, 123 a duplexer, 131 a transmitting-side isolator, 132 a transmitting-side amplifier, 133 a transmitting-side interstage band-pass filter, and 134 a transmitting-side mixer. Also, reference numeral 135 denotes a receiving-side amplifier, 136 a receiving-side interstage band-pass filter, 137 a receiving-side mixer, 138 a voltage-controlled oscillator (VCO), and 139 a local band-pass filter.

Herein, as the transmitting-side isolator 131, a nonreciprocal circuit device (concentrated-constant type isolator) having any one of the center electrode assemblies 1 to 14 which are shown as the above-described first to fourteenth embodiments, can be employed. The mounting of such a nonreciprocal circuit device allows a mobile telephone having stable electrical characteristics and high reliability to be realized.

Other Embodiments

The center electrode assembly, the nonreciprocal circuit device, and the communication apparatus in accordance with the present invention are not limited to the above-described embodiments, but various changes and modifications may be made thereto within the true spirit and scope of the invention.

For example, the center electrode may be partially formed of three or more conductor lines and the conductor lines may be integrally joined at an arbitrary position of the center electrode to form one or another number of conductor lines.

Also, the shape of the ferrite in a plan view may be any one of a circular shape, a polygonal shape, a triangular shape with corners rounded, and the like.

The present invention can also be applied to various nonreciprocal circuit devices including circulators, besides isolators.

The center electrode can also be formed by providing pattern electrodes on a substrate (dielectric substrate, magnetic substrate, laminated substrate etc.), in addition to being formed by stamping out a metallic plate and by bending the stamped plate. Furthermore, instead of using insulating sheets, an insulating film may be formed by means of printing or the like.

Also, the crossing angle G formed between the center electrodes can be in the range of 110° to 140°.

As is evident from the foregoing, in accordance with the first and second aspects of the present invention, since wide parts are formed in the ferrite edge portions at the cold ends of the center electrodes formed of one line, it becomes possible to achieve a center electrode assembly, a nonreciprocal circuit device and a communication apparatus in which the risk of line breakage is significantly reduced, so that the reliability of the center electrodes is increased, and they have stable electrical characteristics.

In accordance with the third aspect of the present invention, since each of the center electrodes has a smooth arc portion and is continuous, where it joins the center planar portion, the stress concentration in bending at this portion is relaxed, and thereby the risk of line breakage is significantly reduced, and the crossing angle formed between the center electrodes is stabilized.

In accordance with the fourth aspect of the present invention, since at least one of the input center electrode, output center electrode, and terminal center electrode has a gradually-increasing width shape wherein the electrode width on the ground electrode side is larger than that on the port portion side, the concentration degree of high-frequency currents on the ground electrode side, which usually exhibits the largest high-frequency currents, is relaxed, thereby improving the insertion loss without impairing the electrical characteristics such as isolation characteristic.

Furthermore, by extending, in the electrode width direction, the edge of each of the input center electrode and the output center electrode, closest to the terminal port portion, so as to provide each of the input center electrode and the output center electrode with a shape which gradually increases in width on one side, wherein the electrode width on the ground electrode side is larger than that on the port portion side, short-circuit failures among the center electrodes can be prevented from occurring.

The nonreciprocal circuit device and the communication apparatus in accordance with the present invention has the center electrode assembly with the above-described features, thereby providing stable electrical characteristics.

What is claimed is:

1. A center electrode assembly, comprising:

an electrode assembly wherein a plurality of center electrodes extends outward from a center planar portion thereof with a predetermined angular separation;

a ferrite:

the center planar portion being abutted against the bottom surface of the ferrite, the center electrodes being wrapped around the top surface of the ferrite across the side surface thereof, and said center electrodes being crossed with each other on the top surface of the ferrite; and at least one center electrode being formed of one line, and said center electrode having a first portion connected to the center planar portion having a first substantially constant line width and a second portion connected to the first portion having a second substantially constant line width that is smaller than the first line width, wherein a portion of the first portion abuts against the top surface of the ferrite.

2. A center electrode assembly, comprising:

an electrode assembly wherein a plurality of center electrodes extends outward from a center planar portion thereof with a predetermined angular separation;

a ferrite;

the center planar portion being abutted against the bottom surface of the ferrite, the center electrodes being wrapped around the top surface of the ferrite across the side surface thereof, and said center electrodes being crossed with each other on the top surface of the ferrite: and at least one center electrode being formed of one line, and said center electrode having a step portion where a line width of the at least one center electrode narrows, wherein the step portion abuts against the top surface of the ferrite.

3. A center electrode assembly, comprising:

an electrode assembly wherein a plurality of center electrodes extends outward from a center planar portion thereof with a predetermined angular separation;

a ferrite;

the center planar portion being abutted against the bottom surface of the ferrite, the center electrodes being wrapped around the top surface of the ferrite across the side surface thereof, and said center electrodes being crossed with each other on the top surface of the ferrite; and at least one of said center electrodes having a first wide portion connected to the center planar portion, a narrow portion connected to the first wide portion, and a second wide portion connected to the narrow portion wherein the narrow portion abuts against the approximate center of the top surface of the ferrite.

4. A center electrode assembly in accordance with claim 1 or claim 2, wherein said electrode assembly comprises first, second, and third center electrodes;

the relationship between a crossing angle $\theta$12formed by the first center electrode and the second center electrode which is adjacent to the first center electrode on one side, and a crossing angle $\theta$31 formed by the first center electrode and the third center electrode which is adjacent to the first center electrode on the other side, being set to be $\theta 12 < \theta 31$; and a width of the ferrite side surface portion of the first center electrode being larger at the portion thereof closer to the third center electrode than at the portion thereof closer to the second center electrode, with respect to the center line at the ferrite center portion.

5. A center electrode assembly in accordance with claim 1 or claim 2, wherein said electrode assembly comprises first, second, and third center electrodes;

the relationship between a crossing angle θ12 formed by the first center electrode and the second center electrode which is adjacent to the first center electrode on one side, and a crossing angle θ31 formed by the first center electrode and the third center electrode which is adjacent to the first center electrode on the other side, being set to be θ12>θ31; and a width of the ferrite side surface portion of the first center electrode being larger at the portion thereof closer to the second center electrode than at the portion thereof closer to the third center electrode, with respect to the center line at the ferrite center portion.

6. A center electrode assembly in accordance with claim 1, 2, or 3, wherein two center electrodes are formed of one line, and wherein one center electrode is formed of two lines.

7. A center electrode assembly, comprising:

a ferrite;

an Input center electrode, an output center electrode, and a terminal center electrode which are provided on a first main surface of said ferrite so as to intersect one another at predetermined angles;

a ground electrode which is disposed on a second main surface of said ferrite, and to which one end portion of each of said input center electrode, said output center electrode, and said terminal center electrode is electrically connected;

an input port portion, an output port portion, and a terminal port portion which are connected to the other ends of said input center electrode, said output center electrode, and said terminal center electrode, respectively; and at least one of said input center electrode, said output center electrode, and said terminal center electrode has a shape wherein its width gradually increases by extending only one edge thereof in the electrode width direction.

8. A nonreciprocal circuit device, comprising:

a permanent magnet;

a center electrode assembly in accordance with claim 1, 2, 3, or 7, said center electrode assembly being subjected to a DC magnetic field by said permanent magnet; and a case accommodating said permanent magnet and said center electrode assembly.

9. A communication apparatus including a nonreciprocal circuit device in accordance with clam 8, and connected thereto, a communication circuit comprising one of a transmitting circuit and a reception circuit.

* * * * *